US011787676B2

(12) United States Patent
Tetreau

(10) Patent No.: US 11,787,676 B2
(45) Date of Patent: Oct. 17, 2023

(54) HEAVY LOAD LIFTING SYSTEM

(71) Applicant: Nicholas J. Tetreau, Bad Axe, MI (US)

(72) Inventor: Nicholas J. Tetreau, Bad Axe, MI (US)

( * ) Notice: Subject to any disclaimer, the term of this patent is extended or adjusted under 35 U.S.C. 154(b) by 168 days.

(21) Appl. No.: 17/524,613

(22) Filed: Nov. 11, 2021

(65) Prior Publication Data

US 2022/0144608 A1 May 12, 2022

Related U.S. Application Data

(60) Provisional application No. 63/112,531, filed on Nov. 11, 2020.

(51) Int. Cl.
*B66F 7/26* (2006.01)
*B66F 7/28* (2006.01)

(52) U.S. Cl.
CPC . *B66F 7/26* (2013.01); *B66F 7/28* (2013.01)

(58) Field of Classification Search
CPC ..... B66F 7/26; B66F 7/28
USPC ..... 269/17; 254/4 B, 4 R, 7 B, 93 I, 6 C
See application file for complete search history.

(56) References Cited

U.S. PATENT DOCUMENTS 3,841,603 A * 10/1974 Lund ..... B66C 23/48 254/47
4,810,151 A * 3/1989 Shern ..... E04F 21/0023 414/11
5,078,364 A * 1/1992 Harrell ..... B62B 3/0637 254/387
5,632,475 A * 5/1997 McCanse ..... B25H 1/0007 269/69

(Continued)

FOREIGN PATENT DOCUMENTS

CA 2573186 C 2/2014
KR 20040046442 A 6/2004

OTHER PUBLICATIONS

Brackett, Bruce E. and Lawson, Daniel E., Prototype drill for core sampling fine-grained perennially frozen ground, CRREL report, Jan. 1985.

(Continued)

*Primary Examiner* — Don M Anderson
*Assistant Examiner* — Jonathan R Zaworski

(57) ABSTRACT

A heavy load lifting system is a system that enables a repairman to safely lift and mount different vehicle components for maintenance or repair. The system may include an elongated frame, a wheeled base, a height-adjustment carriage, a telescopic boom, a pivot support assembly, a tilt-adjustment mechanism, and a winch mechanism. The elongated frame enables the height-adjustment carriage to be raised so that the vehicle component can be removed from the vehicle. The wheeled base enables the system to be moved around. The height-adjustment carriage enables the operator to elevate or lower the telescopic boom. The telescopic boom enables the vehicle component to be removed safely. The pivot support assembly provides additional support to the vehicle component being removed. The tilt-adjustment mechanism enables the telescopic boom to position the removed vehicle component at the desired orientation. The winch mechanism enables the height-adjustment carriage to be moved along the elongated frame.

20 Claims, 17 Drawing Sheets

(56) References Cited

U.S. PATENT DOCUMENTS

| | | | | |
|---|---|---|---|---|
| 5,975,826 | A * | 11/1999 | Scholder | B66F 9/06 414/490 |
| 6,485,001 | B1 * | 11/2002 | Mallery | B66C 23/48 254/4 B |
| 7,429,035 | B2 * | 9/2008 | Metcalf | B66C 23/48 254/4 B |
| 8,201,809 | B2 * | 6/2012 | Bolton | B66C 23/48 414/490 |
| 8,267,620 | B2 | 9/2012 | Wood, II et al. | |
| 8,875,844 | B2 * | 11/2014 | Janz | B66D 1/60 187/244 |
| 2001/0040233 | A1 * | 11/2001 | Chamberlain | B66F 7/02 254/4 R |
| 2021/0395057 | A1 * | 12/2021 | Taylor | B66F 7/28 |

OTHER PUBLICATIONS

Danger Label, Retrieved from Internet, Retrieved on Jun. 1, 2020 <URL: https://www.mysafetysign.com/Truck-Labels/Danger-Electrocution-Hazard-Label/SKU-LB-1501.aspx>.

* cited by examiner

HEAVY LOAD LIFTING SYSTEM

The current application claims a priority to the U.S. provisional patent application Ser. No. 63/112,531 filed on Nov. 11, 2020.

FIELD OF THE INVENTION

The present invention relates generally to lifting equipment and body shop equipment. More specifically, the present invention is a system that enables easy coupling and removal of heavy and/or large components of a vehicle, such as a truck bed or the hood of a truck, by a single person.

BACKGROUND OF THE INVENTION

Lifting equipment and handling/repair stands are essential tools for original equipment and automobile manufacturers as well as independent mechanics active in the repair of automobiles and industrial equipment. Many of these tools are used to provide access to the equipment in need of repair or maintenance. During the repair or maintenance process, the piece of equipment, such as an automotive engine or transmission, is lifted in place and fastened to an equipment mount so that the repairman can have full access to the equipment. Lifting equipment is employed to lift especially heavy parts up to the equipment mount. In other cases, two or more repairmen lift, hold, and support the piece of equipment until the equipment is secured to the equipment mount. Those with experience in the field understand that care must be taken to avoid bodily injury that can occur in the lifting, or in the accidental dropping, of the equipment during the mounting process. However, the lifting equipment and handling/repair stands currently available can be uncomfortable and sometimes unsafe to use by a single person, which results in more manpower and greater safety measures to be employed.

Prior art is available that tries to provide a tool or system that helps repairmen to lift heavy or large equipment for repair or maintenance. For example, there are different pick-up truck box removal tools that permit the removal of a cargo box from a light truck for repair of the box or the truck and replacement of the box following completion of the repair by a single person without assistance from another individual. However, several drawbacks are associated with this prior art. For example, these tools are specifically designed to remove the pick-up truck box, which means the lack versatility if the user wants to employ the prior art to work on other equipment such as the hood of the truck. Moreover, the prior art does not include any safety features to protect the operator from injury, which makes the prior art unsafe to use by a single person. Therefore, an objective of the present invention is to provide a versatile and safe lifting system that can be operated by a single person to remove and reattach heavy and/or large vehicle components for repair or maintenance.

SUMMARY OF THE INVENTION

The present invention is a heavy load lifting system that can be used to remove large and/or heavy components of a vehicle, such as a semi hood, a bus hood, a camper topper, a fifth wheel, a door, etc. The present invention can be operated by a single person without risking the safety of the operator or risking damages to the vehicle components being lifted. The present invention includes an elongated frame mounted on a wheeled base that is strong enough to support the load of the vehicle components being lifted. A height-adjustment carriage on the elongated frame supports a telescopic boom that is used to securely lift the vehicle components to be worked on. Various operational features are provided that help the operator to tilt, move, and rotate the vehicle components in an efficient and safe manner. In addition, various attachments are provided that enable the present invention to be used with vehicle components of different shapes and sizes. Additional features and benefits of the present invention are further discussed in the sections below.

DETAIL DESCRIPTIONS OF THE INVENTION

The foregoing and other objects and advantages will appear from the description to follow. It is to be understood, however, that the present invention may be embodied in various forms. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

Figure 1:
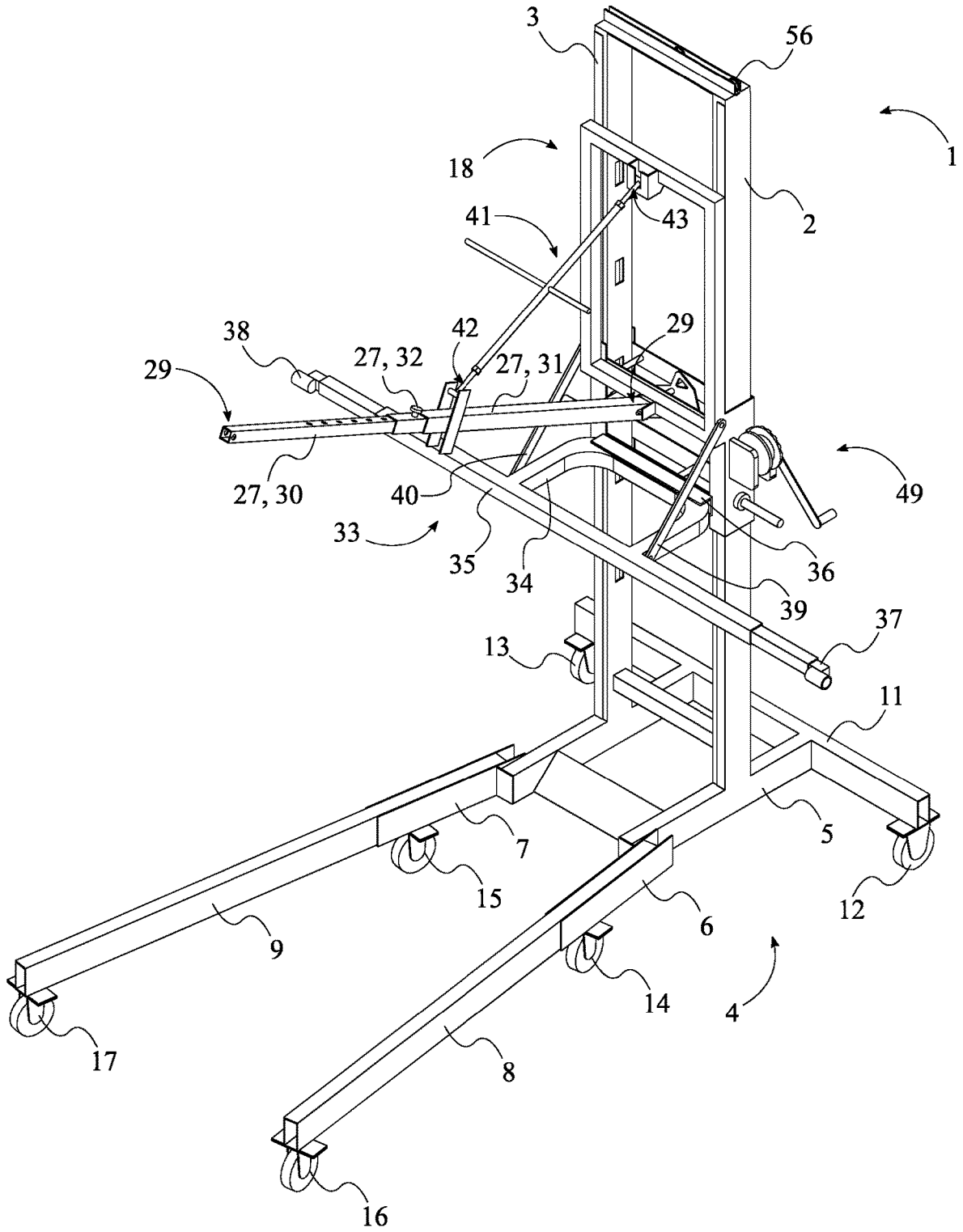
FIG. 1 is a top front perspective view showing the present invention.
Figure 7:
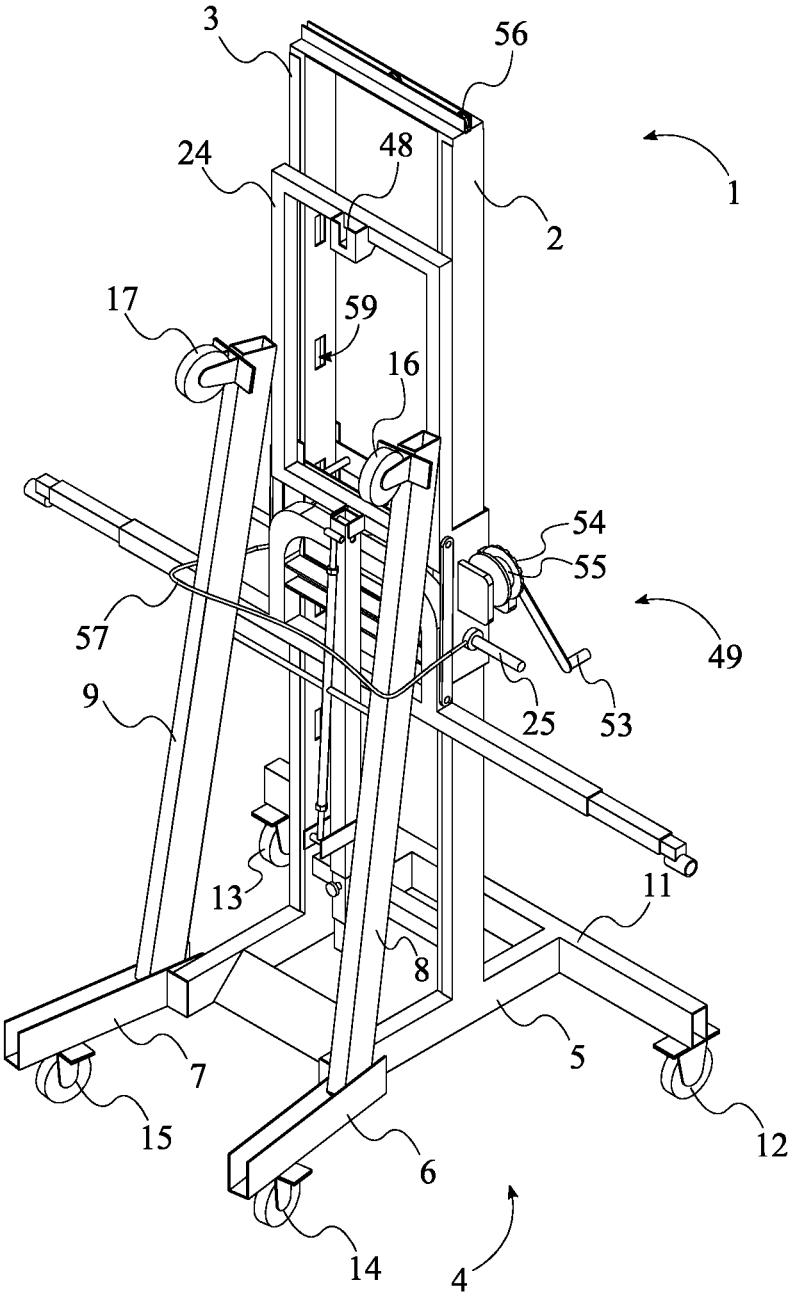
FIG. 7 is a top front perspective view showing the present invention, wherein the present invention is shown in a storage configuration.
Figure 8:
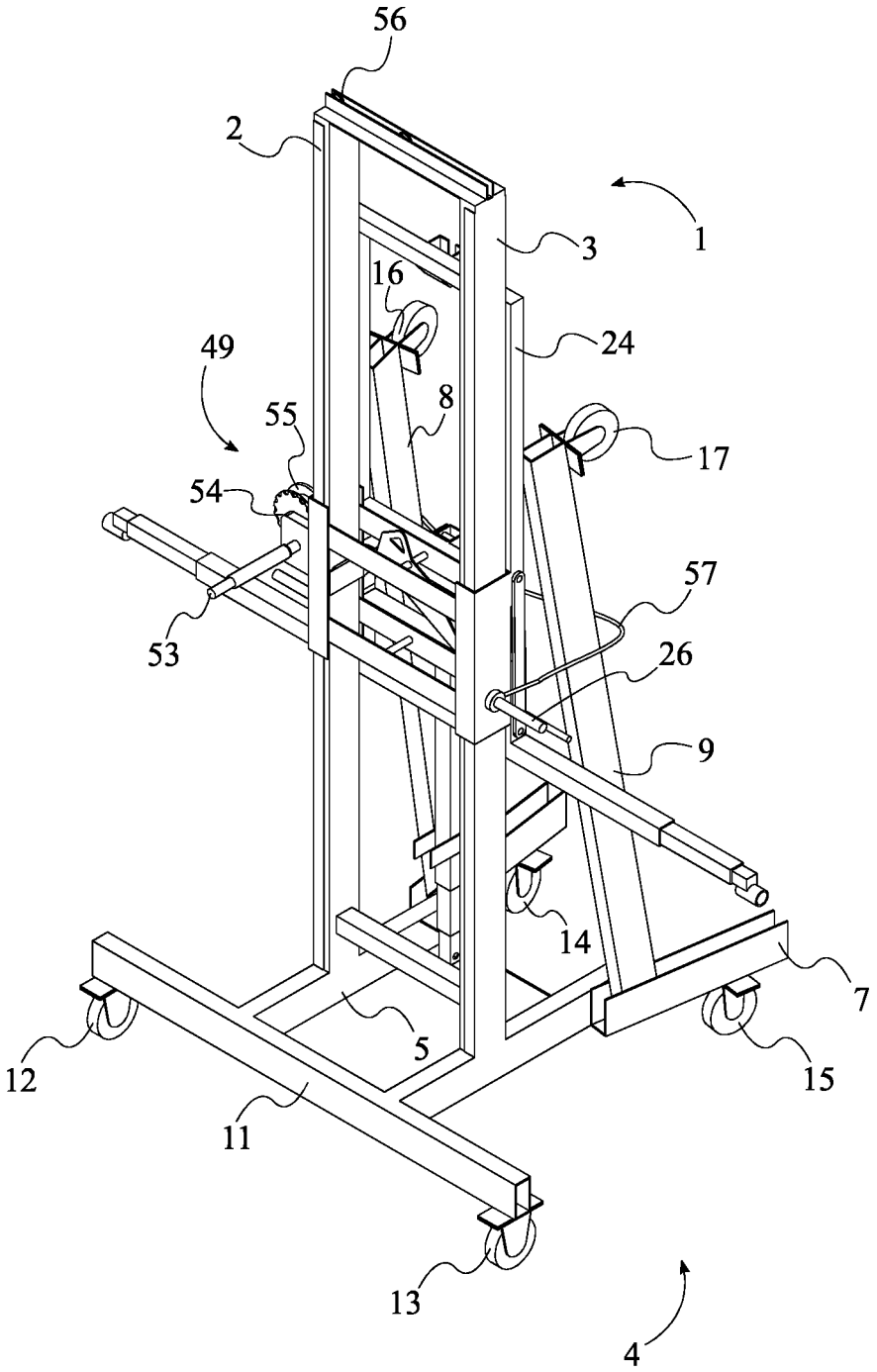
FIG. 8 is a top rear perspective view showing the present invention, wherein the present invention is shown in the storage configuration.

The present invention is a heavy load lifting system that enables a single repairman to safely lift and mount heavy and/or large vehicle components for repair or maintenance. As can be seen in FIGS. 1, 7, and 8, the present invention may comprise an elongated frame 1, a wheeled base 4, a height-adjustment carriage 18, a telescopic boom 27, a pivot support assembly 33, a tilt-adjustment mechanism 41, and a winch mechanism 49. The elongated frame 1 enables the height-adjustment carriage 18 to be raised so that the desired vehicle component can be lifted and removed from the vehicle for repair or maintenance. The wheeled base 4 enables the elongated frame 1 with the removed vehicle component to be moved around the shop. The height-adjustment carriage 18 enables the operator to elevate or lower the telescopic boom 27 as necessary. The telescopic boom 27 enables the vehicle component to be removed without compromising the safety of the operator or risking damage to the vehicle component or the surroundings. The pivot support assembly 33 provides additional support to the vehicle component being removed. The tilt-adjustment mechanism 41 enables the telescopic boom 27 to be tilted at different angles to position the removed vehicle component at the desired orientation for repair or maintenance. Finally, the winch mechanism 49 enables the height-adjustment carriage to be manually moved along the elongated frame 1.

Figure 2:
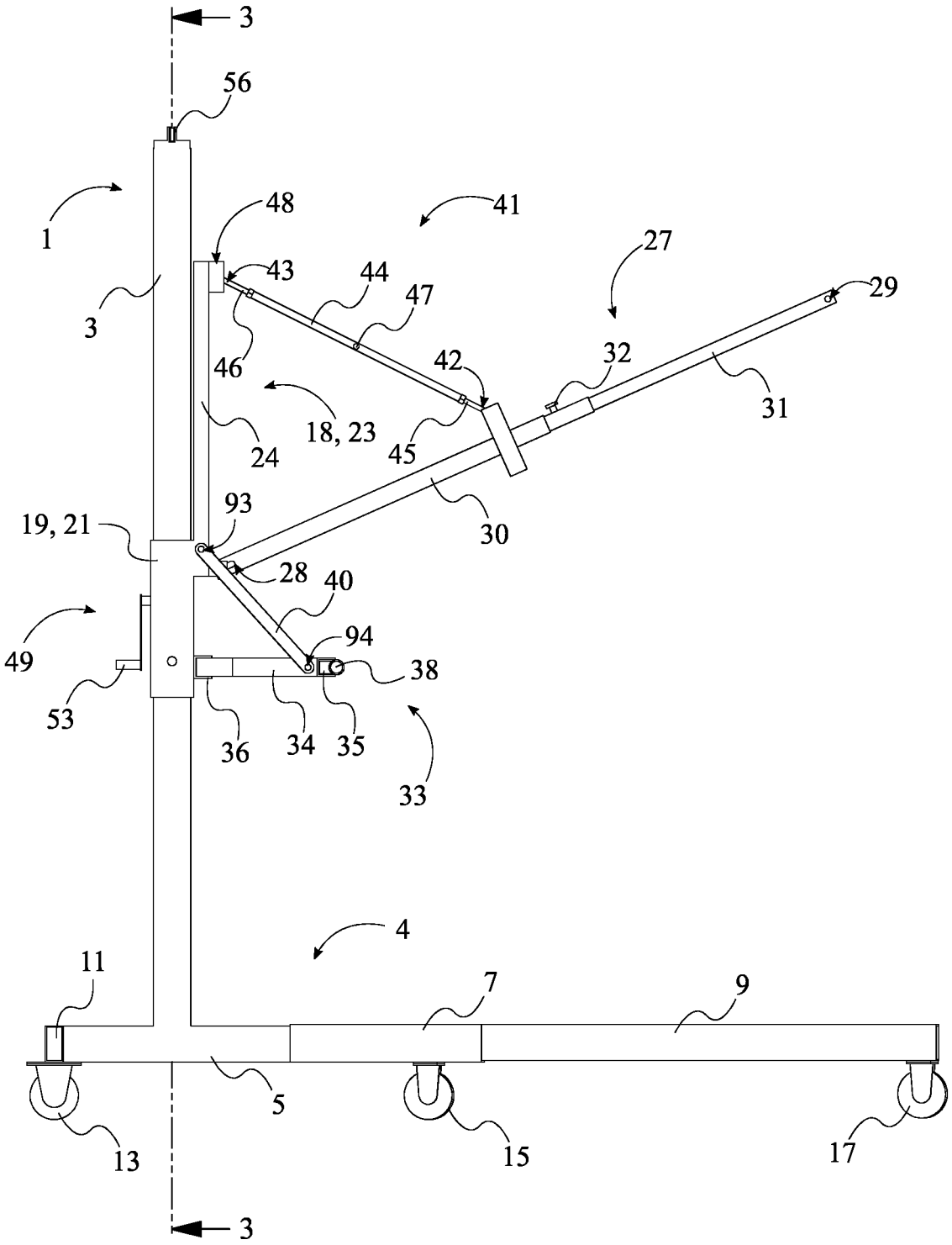
FIG. 2 is a right-side view showing the present invention.
Figure 4:
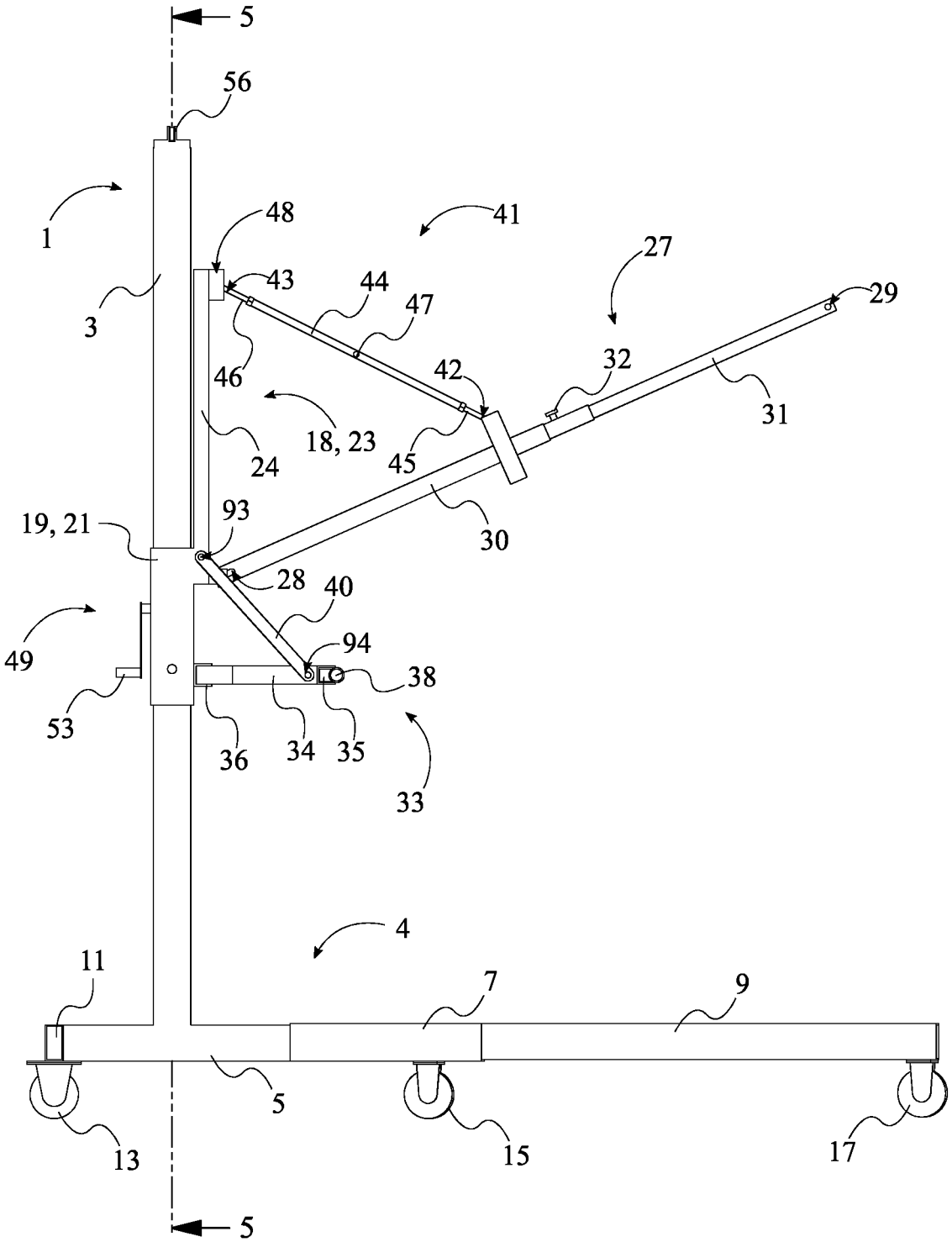
FIG. 4 is a right-side view showing the present invention, wherein the height-adjustment carriage has dropped due to failure of the winch mechanism.
Figure 9:
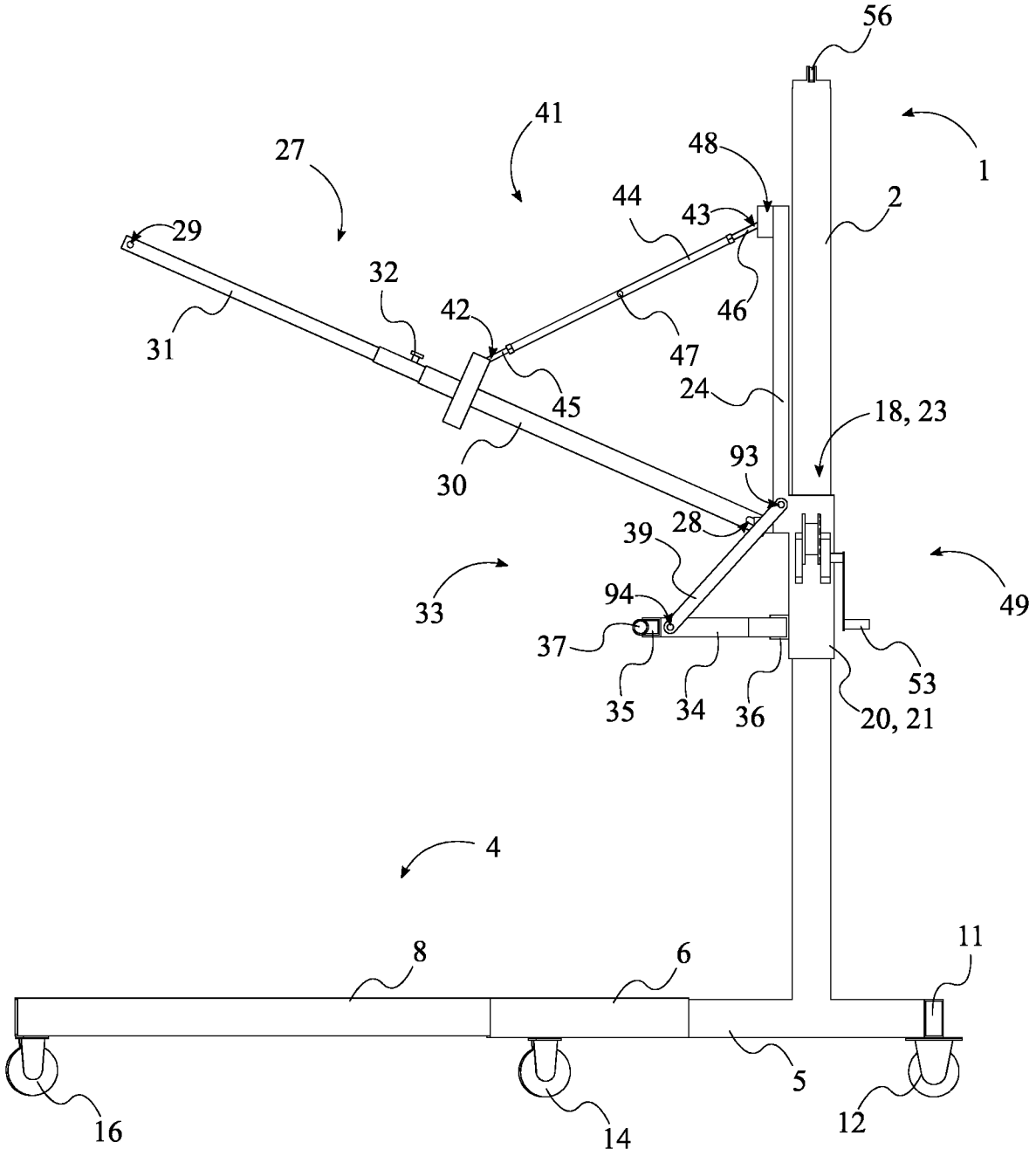
FIG. 9 is a left-side view showing the present invention.
Figure 10:
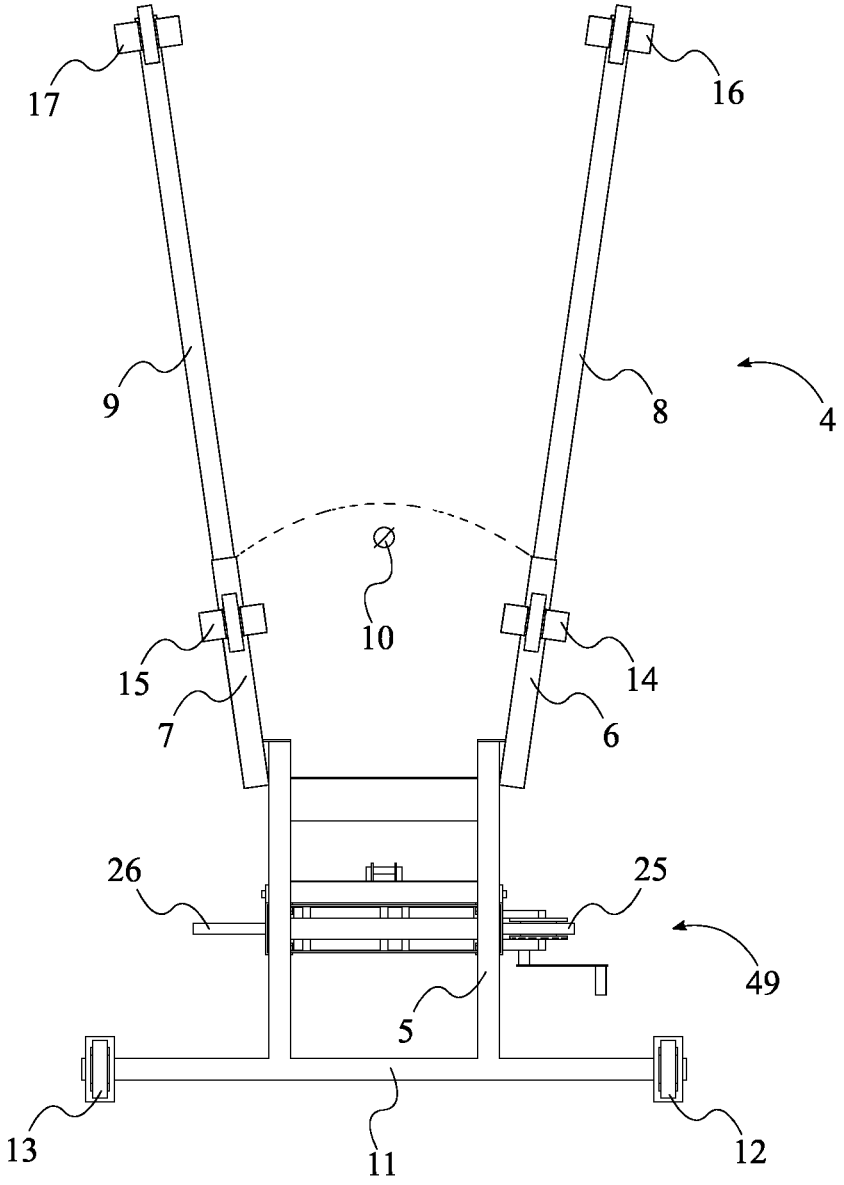
FIG. 10 is a bottom view showing the present invention, wherein the present invention is shown without the telescopic boom, the tilt-adjustment mechanism, nor the pivot support assembly.

The general configuration of the aforementioned components enables a single operator to safely and securely remove a vehicle component for repair or maintenance without the need of different equipment or additional manpower. As can be seen in FIGS. 2, 4, and 9, the telescopic boom 27 is designed to enable the operator to reach vehicle components that are not easily reachable. For example, the telescopic boom 27 can be enlarged to reach the center of the truck bed or the top of the hood of a truck. The telescopic boom 27 comprises a first boom end 28 and a second boom end 29 corresponding to the terminal ends of the telescopic boom 27. Similar to the telescopic boom 27, the tilt-adjustment mechanism 41 is an elongated structure that can be enlarged or shortened to adjust the tilt angle of the telescopic boom 27. So, the tilt-adjustment mechanism 41 also comprises a first mechanism end 42 and a second mechanism end 43 corresponding to the terminal ends of the elongated structure. To secure the wheeled base 4 to the elongated frame 1, the wheeled base 4 is terminally mounted to the elongated frame 1. This forms a solid structure able to support the load from the vehicle component. The height-adjustment carriage 18 is slidably mounted along the elongated frame 1 so that the operator can manually adjust the height of the height-adjustment carriage 18 from the ground.

As can be seen in FIGS. 2, 4, and 9, to ensure that the telescopic boom 27 is secured to the height-adjustment carriage 18, the first boom end 28 is hingedly connected to the height-adjustment carriage 18. This enables the telescopic boom 27 to pivot about the first boom end 28. In addition, the pivot support assembly 33 is mounted onto the height-adjustment carriage 18, offset from the first boom end 28. The positioning of the pivot support assembly 33 enables the pivot support assembly 33 to carry some of the load of the vehicle component under the telescopic boom 27. Further, the first mechanism end 42 is hingedly and laterally connected to the telescopic boom 27. This enables the operator to adjust the tilt of the telescopic boom 27 upwards so that portions of the vehicle component can be raised even higher. On the other hand, the second mechanism end 43 is attached to the height-adjustment carriage 18 to secure the tilt-adjustment mechanism 41 to the height-adjustment carriage 18. Finally, the winch mechanism 49 is operatively coupled between the elongated frame 1 and the height-adjustment carriage 18 to enable the operator to adjust the height of the height-adjustment carriage 18. The winch mechanism 49 is used to raise and lower the height-adjustment carriage 18 along the elongated frame 1, which in turn raises or lowers the vehicle component hanging from the telescopic boom 27.

As can be seen in FIG. 2 through 5, to provide the proper support to the overall system, the elongated frame 1 may comprise a first rail 2 and a second rail 3 that create an elongated structure without adding much weight to the system. To match the design of the first rail 2 and the second rail 3 of the elongated frame 1, the height-adjustment carriage 18 may comprise a first rail-receiving guide 19 and a second rail-receiving guide 20. Both the first rail-receiving guide 19 and the second rail-receiving guide 20 maintain the height-adjustment carriage 18 in the right orientation so that the height-adjustment carriage 18 moves straight along the elongated frame 1. The first rail 2 and the second rail 3 are positioned parallel to each other to form an upright structure. The first rail-receiving guide 19 and the second rail-receiving guide 20 are similarly positioned opposite to each other across the height-adjustment carriage 18 to match the position of the first rail 2 and the second rail 3. Further, the first rail-receiving guide 19 is movably engaged along the first rail 2. Likewise, the second rail-receiving guide 20 is also movably engaged along the second rail 3. Thus, the height-adjustment carriage 18 linearly moves along the elongated frame 1 without risk of the height-adjustment carriage 18 rotating due to a moment force caused by the load of the vehicle component.

In one embodiment, the first rail-receiving guide 19 and the second rail-receiving guide 20 may each comprise a guide body 21 and at least one guide roller 22. As can be seen in FIG. 2 through 5, the at least one guide roller 22 enables the corresponding guide to move along the corresponding rail. The guide body 21 keeps at least one guide roller 22 in position so that the at least one guide roller 22 does not accidentally disengage from the corresponding rail. The guide body 21 is integrated into the height-adjustment carriage 18 so that the height-adjustment carriage 18 moves along with the guide body 21. The at least one guide roller 22 is rotatably mounted to the guide body 21 to enable the movement of the guide body 21 along the corresponding rail. So, to enable the movement of the height-adjustment carriage 18 along the elongated frame 1, the at least one guide roller 22 of the first rail 2-receiving guide is rollably engaged to the first rail 2. The at least one guide roller 22 of the second rail-receiving guide 20 is also rollably engaged to the second rail 3. In some embodiments, multiple protection strips can be attached along the surfaces of the rails where the rollers contact the rails to prevent damage to the rails due to friction caused by the rolling of the rollers. In other embodiments, different translation mechanisms can be utilized for the first rail-receiving guide 19 and the second rail-receiving guide 20.

A common problem with lifting equipment is the large space the equipment takes when not in use, which limits the workspace available in a shop. To use the least space as possible when not in use, the wheeled base 4 of the present invention is provided with a foldable design. So, as can be seen in FIG. 7 through 11, wheeled base 4 may comprise a base body 5, a first base leg 6, a second base leg 7, a first leg extension 8, and a second leg extension 9. The base body 5 corresponds to the portion of the wheeled base 4 that connects to the elongated frame 1. The first base leg 6 and the second base leg 7 provide lateral support to prevent the overall assembly from tipping forward. The first leg extension 8 and the second leg extension 9 increase the support to the overall elongated frame 1 while enabling the wheeled base 4 to be folded when stored away. To form a solid wheeled base 4, the first base leg 6 and the second base leg 7 are connected adjacent the base body 5. The first base leg 6 and the second base leg 7 are positioned offset from each other to increase the overall surface area of the wheeled base 4. In addition, to add lateral support to the elongated frame 1, the first base leg 6 and the second base leg 7 are oriented away from the elongated frame 1. The orientation of the first base leg 6 and the second base leg 7 not only prevent the elongated frame 1 from tipping forward, but also from tipping sideways. The first base leg 6 and the second base leg 7 are preferably oriented at an acute angle 10 with each other, but in other embodiments, the angle can be larger or smaller. Further, to enable the folding of the wheeled base 4, the first leg extension 8 is hingedly connected to the first base leg 6 while the second leg extension 9 is hingedly connected to the second base leg 7. Thus, when ready to store, the operator just rotates the first leg extension 8 and the second leg extension 9 upwards and places the first leg extension 8 and the second leg extension 9 against the elongated frame 1. When ready to use, the operator just rotates the first leg extension 8 and the second leg extension 9 downwards until both are placed against the ground.

To enable the operator to control the movement of the wheeled base 4, the wheeled base 4 may further comprise a stabilizing bar 11, a first lockable caster 12, and a second lockable caster 13, as can be seen in FIG. 7 through 11. Both the first lockable caster 12 and the second lockable caster 13 enable the movement of the wheeled base 4 while also enabling the operator to lock the wheeled base 4 in place. The stabilizing bar 11 provides additional lateral support to the elongated frame 1. To form an overall flat structure, the base body 5 is laterally positioned to the stabilizing bar 11. In addition, the stabilizing bar 11 is connected adjacent to the base body 5, opposite to the first base leg 6 and the second base leg 7. The positioning of the stabilizing bar 11 adds greater lateral support to the elongated frame 1 in addition to the first base leg 6 and the second base leg 7. Further, the first lockable caster 12 is terminally connected to the stabilizing bar 11. The second lockable caster 13, on the other hand, is terminally connected to the stabilizing bar 11, opposite the first lockable caster 12. The positioning of the first lockable caster 12 and the second lockable caster 13 prevents tipping of the elongated frame 1 by keeping a wide support base that is less likely to tip over.

In addition to the first lockable caster 12 and the second lockable caster 13, the wheeled base 4 may further comprise a first leg caster 14, a second leg caster 15, a first extension caster 16, and a second extension caster 17 to make moving the wheeled base 4 as easy as possible, as shown in FIG. 7 through 11. The first leg caster 14 is terminally connected to the first base leg 6, offset from the base body 5. Similarly, the second leg caster 15 is terminally connected to the second base leg 7, offset from the base body 5. The positioning of the first leg caster 14 and the second leg caster 15 keeps the whole base body 5 off the ground. Further, the first extension caster 16 is terminally connected to the first leg extension 8, offset from the base body 5. Likewise, the second extension caster 17 is terminally connected to the second leg extension 9, offset from the base body 5. The positioning of the first extension caster 16 and the second extension caster 17 does not obstruct the folding of the first leg extension 8 nor the second leg extension 9. In other embodiments, additional brake casters and/or normal casters can be provided around the wheeled base 4.

Figure 6:
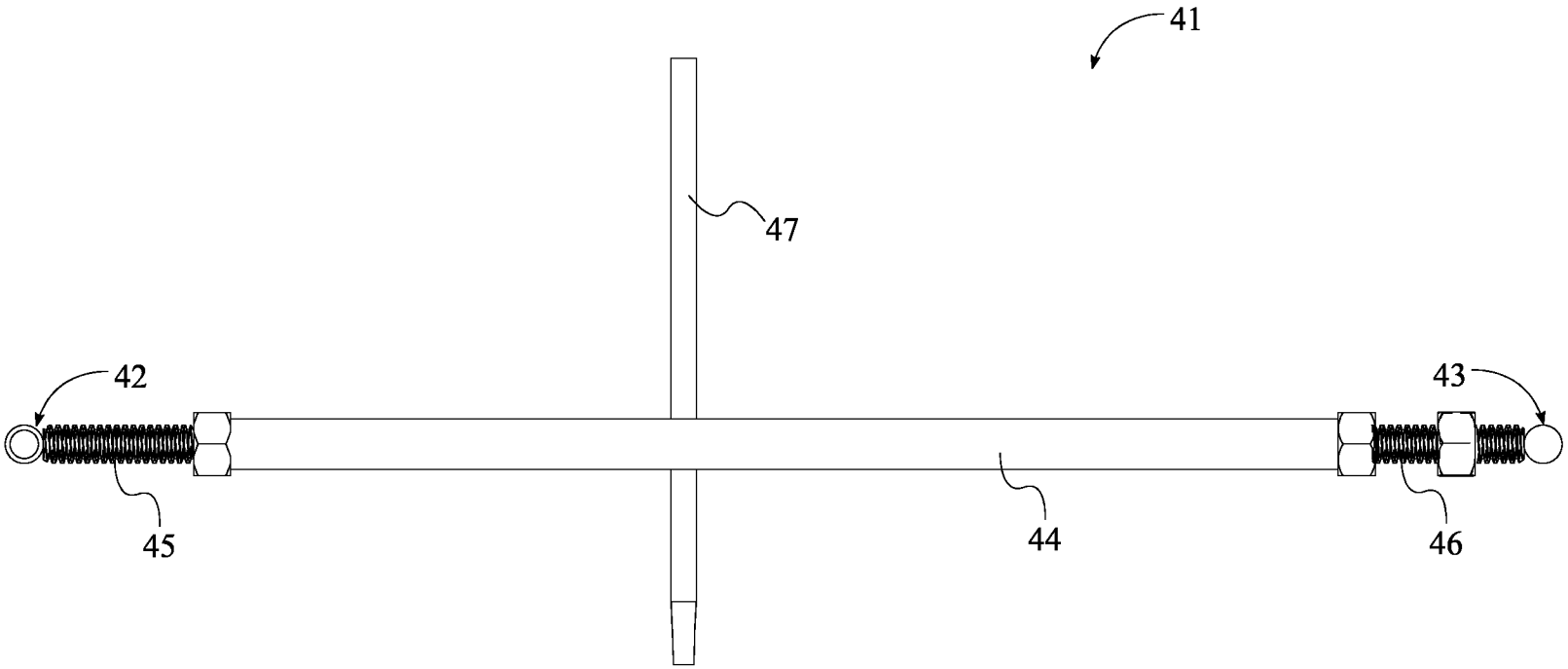
FIG. 6 is a top view showing a first embodiment of the tilt-adjustment mechanism of the present invention.

As previously discussed, the tilt-adjustment mechanism 41 helps the operator tilt the telescopic boom 27 upwards to raise or lower portions of the vehicle component hanging from the telescopic boom 27. To do so, the tilt-adjustment mechanism 41 may comprise a turnbuckle body 44, a first threaded rod 45, a second threaded rod 46, and a turnbuckle handle 47, as shown in FIGS. 2, 4, and 6. The turnbuckle body 44, the first threaded rod 45, and the second threaded rod 46 when assembly form a turnbuckle structure that can be shortened or lengthened to adjust the tilt of the telescopic boom 27. The turnbuckle handle 47 enables the operator to manually adjust the overall length of the turnbuckle structure. To do so, the first threaded rod 45, the turnbuckle body 44, and the second threaded rod 46 are axially positioned with each other. In addition, the first threaded rod 45 is threadably engaged into the turnbuckle body 44. The second threaded rod 46 is also threadably engaged into the turnbuckle body 44, opposite to the second threaded rod 46, which completes the turnbuckle structure. Further, the turnbuckle handle 47 is connected perpendicular to the turnbuckle body 44. This enables the operator to rotate the turnbuckle body 44 by turning the turnbuckle handle 47 around the axis of the turnbuckle body 44. In other embodiments, the tilt-adjustment mechanism 41 may utilize different mechanical means to enable the manual adjustment of the tilt of the telescopic boom 27.

To further facilitate the storage of the whole assembly, the present invention may further comprise a detachable ball-and-socket joint 48 that secures the second mechanism end 43 to the height-adjustment carriage 18 in a removable manner, as shown in FIGS. 2, 4, and 6. In addition, the height-adjustment carriage 18 may comprise a carriage body 23 and a support arch 24. The carriage body 23 preferably corresponds to the overall structure of the height-adjustment carriage 18 while the support arch 24 provides a structure to elevate the detachable ball-and-socket joint 48. To do so, the support arch 24 is connected adjacent the carriage body 23 to form a single and strong structure. The support arch 24 is also oriented away from the wheeled base 4 to maintain the detachable ball-and-socket joint 48 above the telescopic boom 27. Further, the detachable ball-and-socket joint 48 is positioned adjacent to the support arch 24, offset from the carriage body 23, to receive the second mechanism end 43. Then, the second mechanism end 43 can be secured to the height-adjustment carriage 18 by pivotably attaching the second mechanism end 43 to the support arch 24 by the detachable ball-and-socket joint 48. This enables the user to store away the telescopic boom 27 and the tilt-adjustment mechanism 41 by first raising the pivot support assembly 33 upwards, disengaging the detachable ball-and-socket joint 48, lowering the tilt-adjustment mechanism 41, and positioning the tilt-adjustment mechanism 41 against the telescopic boom 27. Then, the operator can lower the telescopic boom 27 along with the tilt-adjustment mechanism 41 until the telescopic boom 27 rests against the height-adjustment carriage 18 and the elongated frame 1. The operator can rise or lower the height-adjustment carriage 18 to accommodate the length of the telescopic boom 27 against the elongated frame 1. Finally, the operator can fold the first leg extension 8 and the second leg extension 9 upwards, which enables the operator to store away the present invention without taking too much space in the shop. On the other hand, to deploy the present invention to work on a vehicle, the operator first moves the system to the desired location, unfolds the first leg extension 8 and the second leg extension 9, raises the telescopic boom 27, raises the tilt-adjustment mechanism 41, engages the detachable ball-and-socket joint 48 to secure the tilt-adjustment mechanism 41 to the height-adjustment carriage 18, and lowers the pivot support assembly 33. In other embodiments, the present invention may include different means to detachably secure the tilt-adjustment mechanism 41 to the height-adjustment carriage 18.

When the present invention is stored away, it is important to prevent accidental deployment of any of the movable parts. So, the present invention may further comprise a safety chain 57 that can be used to keep all folded parts together while the present invention is stored away, as shown in FIGS. 7 and 8. The height-adjustment carriage 18 may further comprise a first handle 25 and a second handle 26. The first handle 25 and the second handle 26 enable the operator to maneuver the present invention when moving the present invention with a vehicle component. The first handle 25 and the second handle 26 also provide locations to which the safety chain 57 can be tethered on the height-adjustment carriage 18. The first handle 25 and the second handle 26 are positioned opposite to each other across the height-adjustment carriage 18 to provide good handling locations on the assembly. The first handle 25 is laterally connected to the height-adjustment carriage 18 to secure the first handle 25 to the height-adjustment carriage 18. Likewise, the second handle 26 is laterally connected to the height-adjustment carriage 18, opposite to the first handle 25, to secure the second handle 26 to the height-adjustment carriage 18. Further, the safety chain 57 is tethered in between the first handle 25 and the second handle 26. So, when storing the present invention away, the operator would first folds together the pivot support assembly 33, the tilt-adjustment mechanism 41, the telescopic boom 27, the first leg extension 8, the second leg extension 9, and then wraps the safety chain 57 around all the components to keep everything together. In other embodiments, the present invention may utilize different means to keep all foldable components together when the present invention is stored away.

As previously discussed, the pivot support assembly 33 is designed to provide additional support to the vehicle component hanging from the telescopic boom 27. To do so, the pivot support assembly 33 may comprise a U-shaped bar 34, a length-adjustable bar 35, and a bar-engagement brace 36, as can be seen in FIGS. 1, 2, 4, and 9. The U-shaped bar 34 and the length-adjustable bar 35 are designed to receive some of the load from the vehicle component raised by the telescopic boom 27. The bar-engagement brace 36 helps secure the assembly to the height-adjustment carriage 18. To form a strong carriage structure, the bar-engagement brace 36 is laterally connected to the height-adjustment carriage 18. The bar-engagement brace 36 is positioned in between the telescopic boom 27 and the wheeled base 4 so that the pivot support assembly 33 is secured under the telescopic boom 27. The U-shaped bar 34 is attached into the bar-engagement brace 36 to secure the pivot support assembly 33 to the height-adjustment carriage 18. The U-shaped bar 34 is also laterally positioned to the length-adjustable bar 35. The length-adjustable bar 35 is positioned perpendicular to the elongated frame 1. Further, the length-adjustable bar 35 is connected adjacent to the U-shaped bar 34, opposite the bar-engagement brace 36. As a result, the length-adjustable bar 35 forms a D-shaped structure with the U-shaped bar 34. When supporting the vehicle component, the length-adjustable bar 35 engages with portions of the vehicle component. The load received is then transferred through the U-shaped bar 34 and the bar-engagement brace 36 to the height-adjustment carriage 18.

To facilitate the engagement of the length-adjustable bar 35 to portions of the vehicle component, the pivot support assembly 33 may further comprise a first mounting bracket 37 and a second mounting bracket 38, as can be seen in FIGS. 1, 2, 4, and 9. The first mounting bracket 37 and the second mounting bracket 38 enable the length-adjustable bar 35 to engage with specific fastening features of the vehicle component. For example, the first mounting bracket 37 and the second mounting bracket 38 may be specifically designed to engage with the tailgate hinge pins of a truck bed. So, the first mounting bracket 37 is terminally mounted to the length-adjustable bar 35. Similarly, the second mounting bracket 38 is terminally mounted to the length-adjustable bar 35, opposite to the first mounting bracket 37. This enables the operator to accommodate different designs of vehicle components by adjusting the overall length of the length-adjustable bar 35 so that the first mounting bracket 37 and the second mounting bracket 38 can safely engage with the corresponding fastening features in the vehicle component, such as the tailgate hinge pins.

Further, to enable the operator to put away the pivot support assembly 33, the pivot support assembly 33 may further comprise a first suspension beam 39 and a second suspension beam 40, as can be seen in FIGS. 1, 2, 4, and 9. The first suspension beam 39 and the second suspension beam 40 enable the pivot support assembly 33 to be folded away in a similar fashion as the other foldable components. The first suspension beam 39 and the second suspension beam 40 each comprises a proximal beam end 93 and a distal beam end 94 corresponding to the terminal ends of the beam structure. The first suspension beam 39 and the second suspension beam 40 are positioned parallel and offset from each other to keep the overall pivot support assembly 33 balanced. The proximal beam end 93 is hingedly connected to the height-adjustment carriage 18 to secure the corresponding suspension beam to the height-adjustment carriage 18. On the other hand, the distal beam end 94 is hingedly connected to the U-shaped bar 34 to secure the corresponding suspension beam to the U-shaped bar 34. This enables the pivot support assembly 33 to hang from the height-adjustable carriage below the telescopic boom 27. To store away the pivot support assembly 33, the operator first disengages the U-shaped bar 34 from the bar-receiving brace, pivots the U-shaped bar 34 upwards, and places the pivot support assembly 33 against the height-adjustment carriage 18. To deploy the pivot support assembly 33, the operator moves the pivot support assembly 33 away from the height-adjustment carriage 18, pivots the U-shaped bar 34 downwards, and engages the U-shaped bar 34 with the bar-engagement brace 36. In other embodiments, the pivot support assembly 33 can be modified to support other vehicle components.

The winch mechanism 49 is preferably designed to enable the user to manually move the height-adjustment carriage 18 up and down the elongated frame 1. To do so, the winch mechanism 49 may comprise a first hoisting cable 50, a first crank 53, a first ratcheting mechanism 54, a first spool 55, and a pulley system 56, as shown in FIGS. 3, 5, 7, and 9. The first hoisting cable 50 is preferably a high-strength cable comprising a first cable end 51 and a second cable end 52 corresponding to the ends of the cable. The first spool 55 is laterally and rotatably connected to the height-adjustment carriage 18 to reel the first hoisting cable 50. The pulley system 56 is terminally mounted to the elongated frame 1, opposite to the wheeled base 4, to provide a fixed point from which the height-adjustment carriage 18 can hang. To connect the first hoisting cable 50 to the first spool 55, the first cable end 51 is laterally connected to the first spool 55. The first hoisting cable 50 is then tethered through the pulley system 56 before the second cable end 52 is connected to the height-adjustment carriage 18. This enables the height-adjustment carriage 18 to hang from the pulley system 56 while enabling the first hoisting cable 50 to be reeled in and out of the first spool 55. To enable the operator to manually spin the first spool 55, the first crank 53 is torsionally connected to the first spool 55. Then, to keep the height-adjustment carriage 18 in place, the first ratcheting mechanism 54 is operatively integrated into the rotatable connection between the first spool 55 and the height-adjustment carriage 18. The first ratcheting mechanism 54 is used to selectively allow rotation of the first spool 55 in one direction and to selectively prevent rotation of the first spool 55 in an opposite direction. So, the operator can raise the height-adjustment carriage 18 by spinning the first spool 55 preferably counterclockwise to reel the first hoisting cable 50 in, which in turn pulls the height-adjustment carriage 18 upwards. On the other hand, to lower the height-adjustment carriage 18, the operator can spin the first spool 55 clockwise to unwind the first hoisting cable 50, which in turn lowers the height-adjustment carriage 18. During both processes, the operator can let go of the first crank 53 without worrying of the first hoisting cable 50 going loose due to the load from the vehicle component as the first ratcheting mechanism 54 locks the first spool 55 into position.

Figure 3:
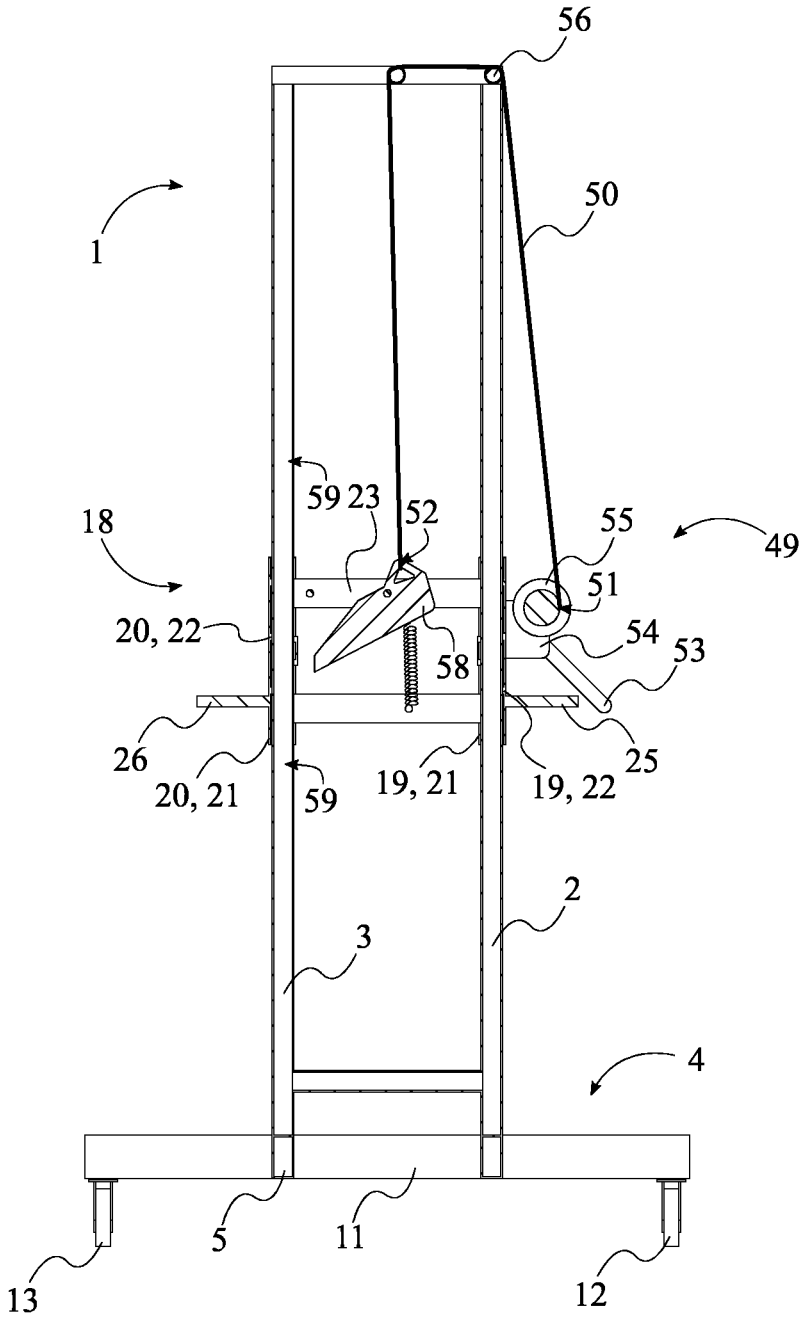
FIG. 3 is a vertical cross-sectional view taken along line 3-3 in FIG. 2, wherein the spring-loaded safety latch is shown during normal operation of the winch mechanism.
Figure 5:
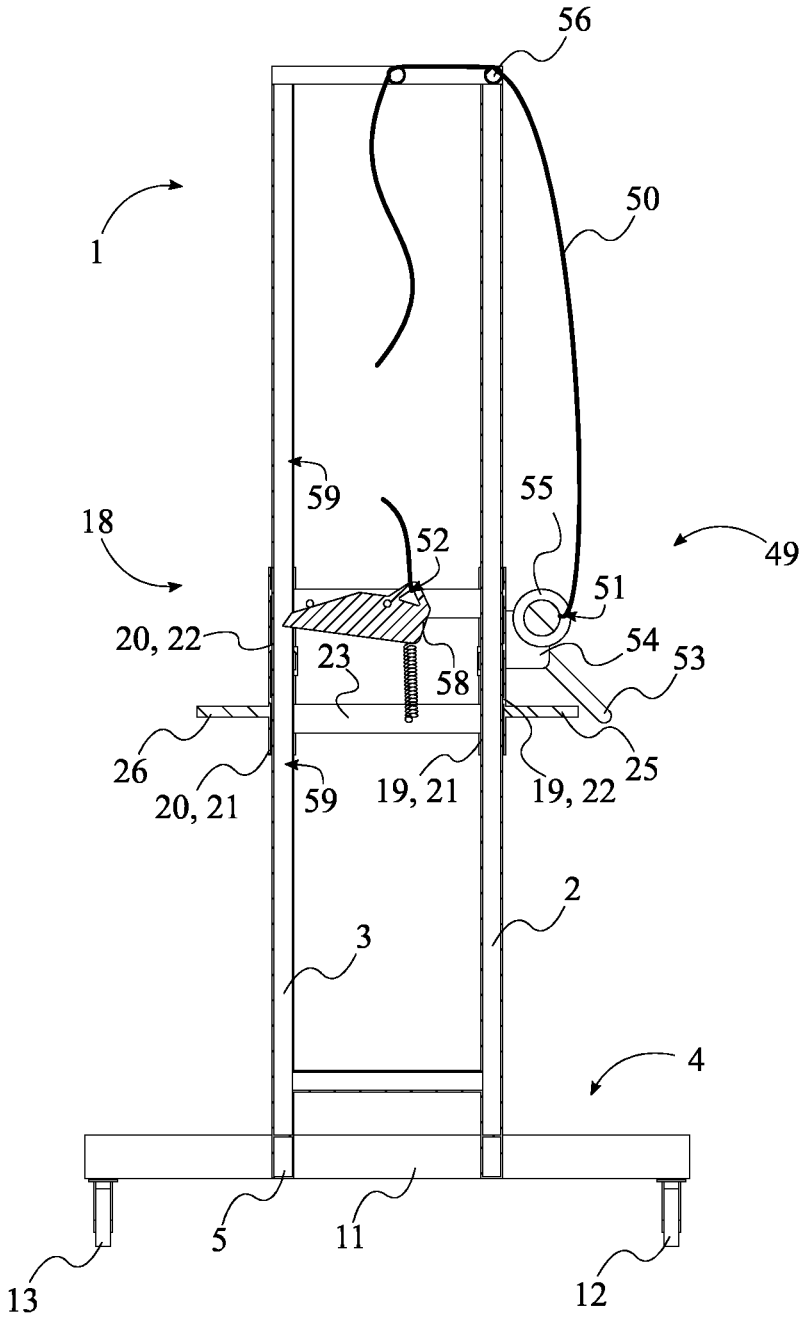
FIG. 5 is a vertical cross-sectional view taken along line 5-5 in FIG. 4, wherein the spring-loaded safety latch is shown engaged after failure of the winch mechanism.
Figure 11:
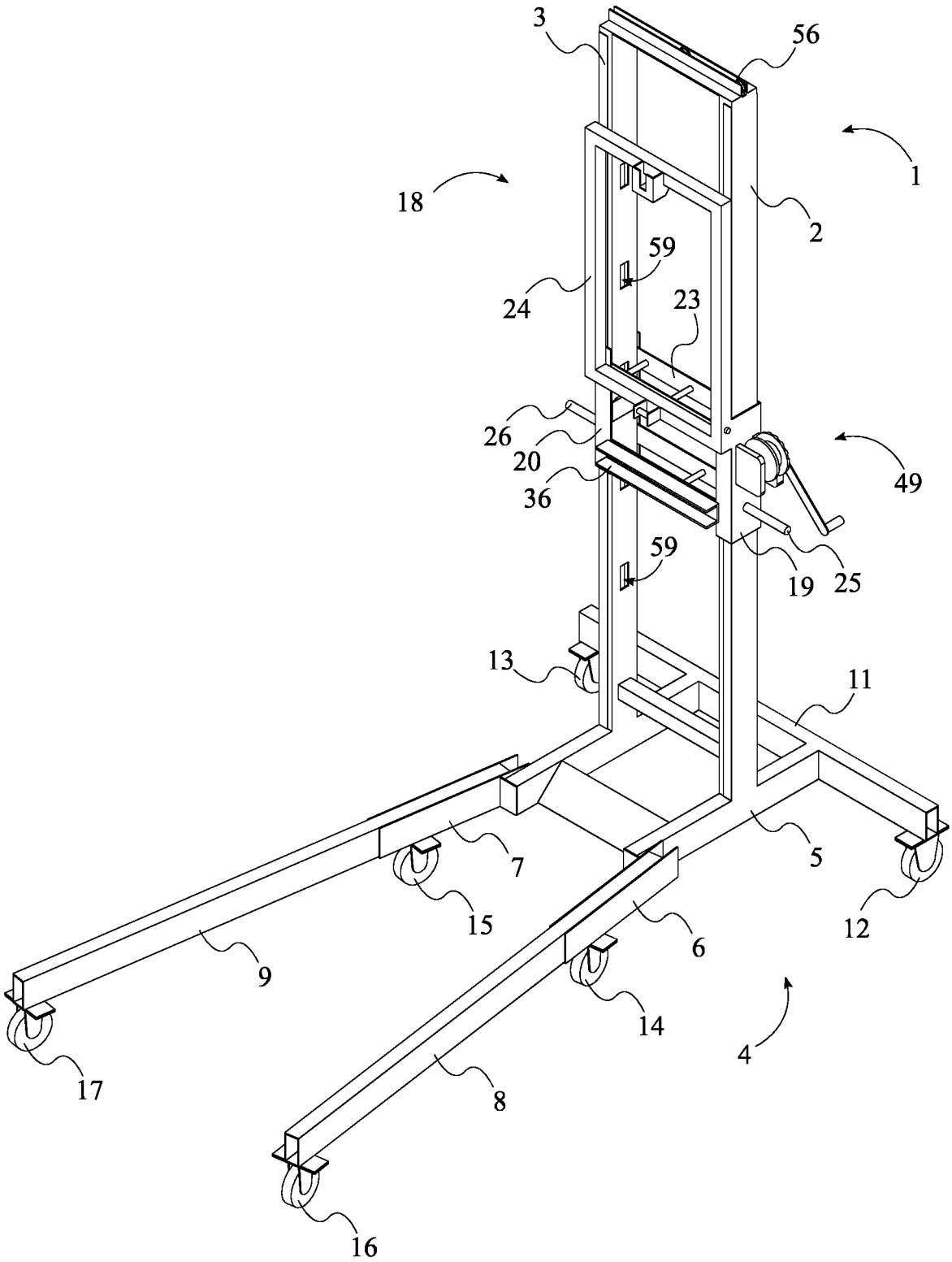
FIG. 11 is a top front perspective view showing the present invention, wherein the present invention is shown without the telescopic boom, the tilt-adjustment mechanism, nor the pivot support assembly.

In case the first hoisting cable 50 snaps, the first ratcheting mechanism 54 fails, or the pulley system 56 breaks, the present invention may further comprise a spring-loaded safety latch 58 that is engaged after the failure to lock the height-adjustment carriage 18 into position. As can be seen in FIGS. 3, 5, and 11, the present invention may further comprise a plurality of latch slots 59 which the spring-loaded safety latch 58 can engage to. The spring-loaded safety latch 58 is hingedly connected within the height-adjustment carriage 18 to secure the spring-loaded safety latch 58 to the height-adjustment carriage 18. The second cable end 52 is tethered to the height-adjustment carriage 18 by the spring-loaded safety latch 58 in such a way that the spring mechanism of the spring-loaded safety latch 58 is always in tension due to the first hoisting cable 50 pulling on the spring-loaded safety latch 58. The plurality of latch slots 59 is distributed along the elongated frame 1 to provide enough slots which the spring-loaded safety latch 58 can engage to so that the height-adjustment carriage 18 does not hit the wheeled base 4. The plurality of latch slots 59 is also integrated within the elongated frame 1 to match the location of the spring-loaded safety latch 58. So, when any component of the winch mechanism 49 fails, the tension on the spring mechanism of the spring-loaded safety latch 58 will be released, which causes the spring-loaded safety latch 58 to pivot until the spring-loaded safety latch 58 engages with a slot of the plurality of latch slots 59. A stopper can also be provided within the height-adjustment carriage 18 which ensures the spring-loaded safety latch 58 engages with a slot of the plurality of latch slots 59. In other embodiments, the present invention may utilize different safety mechanisms in case the winch mechanism 49 fails.

As previously discussed, the telescopic boom 27 enables the operator to reach hard-to-reach section of the vehicle component to be repaired or maintained. To do so, the telescopic boom 27 may further comprise a first boom pole 30, a second boom pole 31, and a locking mechanism 32, as shown in FIGS. 2, 4, and 9. The first boom pole 30 and the second boom pole 31 enable the telescopic boom 27 to be enlarged or shortened. The locking mechanism 32 enables the operator to lock the overall length of the telescopic boom 27 in place. To form the structure of the telescopic boom 27, the first boom pole 30 is positioned coincident to the first boom end 28. The second boom pole 31 is also positioned coincident to the second boom end 29. To secure the first boom pole 30 and the second boom pole 31 together, the first boom pole 30 and the second boom pole 31 are telescopically engaged with each other. Further, to lock a desired length of the telescopic boom 27, the locking mechanism 32 is operatively integrated between the first boom pole 30 and the second boom pole 31. The locking mechanism 32 is used to lock the second boom pole 31 in place along the first boom pole 30. For example, the locking mechanism 32 can include a knob screw threadably engaged with a hole on the first boom pole 30. So, the operator can loosen the knob screw to adjust the overall length of the telescopic boom 27 and the tighten the knob screw to lock the second boom pole 31 in place along the first boom pole 30. In other embodiments, the telescopic boom 27 can utilize other mechanical means to enable the manual length adjustment of the telescopic boom 27 by a single operator.

Figure 12:
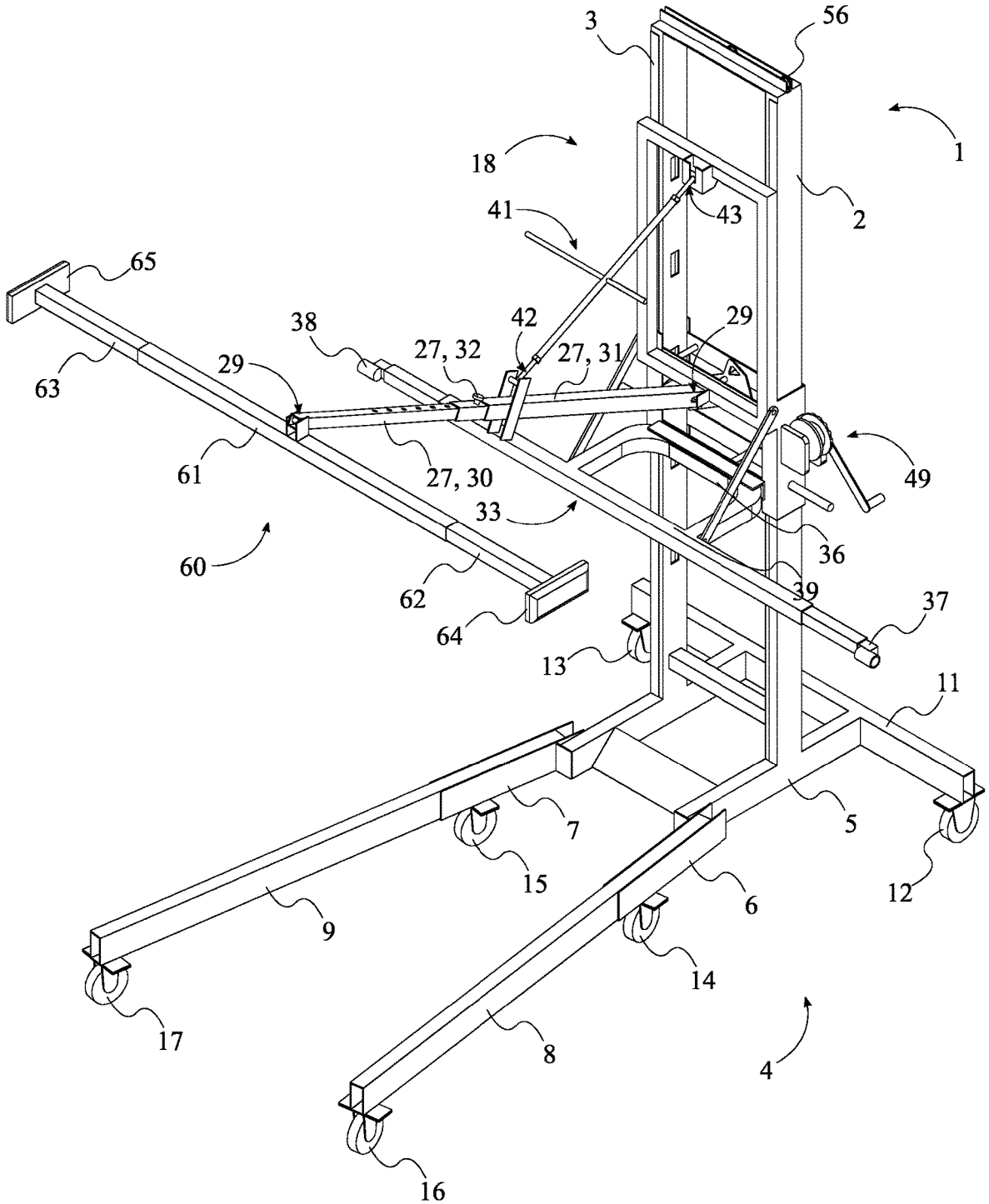
FIG. 12 is a top front perspective view showing the present invention, wherein the present invention is shown with a clamping bar attached to the telescopic boom.

As initially discussed, the present invention is versatile enough to be used with different vehicle components, such as a truck bed or the hood of a trailer. To help the operator to work on a truck bed, the present invention may further comprise a clamping bar 60. As can be seen in FIG. 12, the clamping bar 60 is designed to engage with the interior walls of the truck bed. To do so, the clamping bar 60 may comprise a bar body 61, a first extension arm 62, a second extension arm 63, a first frictional bracket 64, and a second frictional bracket 65. The bar body 61 is designed to be engaged with the telescopic boom 27. The first extension arm 62 and the second extension arm 63 enable the operator to accommodate the length of the clamping bar 60 to the interior width of the truck bed. The first frictional bracket 64 and the second frictional bracket 65 engage with the interior walls of the truck bed to secure the clamping bar 60 to the truck bed. To raise the truck bed using the clamping bar 60, the bar body 61 is positioned perpendicular to the telescopic boom 27. The second boom end 29 is laterally positioned to the bar body 61 to form an overall T-shaped structure with the bar body 61. The bar body 61 is then hingedly connected to the second boom end 29 so that bar body 61 can moved around the second boom end 29. Furthermore, the first extension arm 62 is telescopically engaged with the bar body 61. The second extension arm 63 is also telescopically engaged with the bar body 61, opposite to the first extension arm 62. This enables the overall clamping bar 60 to be shortened or lengthened at both ends. In addition, the first frictional bracket 64 is terminally connected to the first extension arm 62, offset the bar body 61. Similarly, the second frictional bracket 65 is terminally connected to the second extension arm 63, offset the bar body 61. This positions the frictional brackets on opposite ends of the clamping bar 60. So, to secure the clamping bar 60 to the truck bed, the operator adjusts the overall length of the clamping bar 60 using the first extension arm 62 and the second extension arm 63. The first frictional bracket 64 and the second frictional bracket 65 must be tightly placed against the opposite interior walls of the truck bed. In addition, the pivot support assembly 33 is engaged with the trailer pivot hinges so that the truck bed also rests on the pivot support assembly 33. Once everything is fastened, the operator can raise the height-adjustment carriage 18 using the winch mechanism 49 until the clamping bar 60 fully engages with the truck bed. Then, the operator can further raise the height-adjustment carriage 18 to fully remove the truck bed from the truck.

Figure 13:
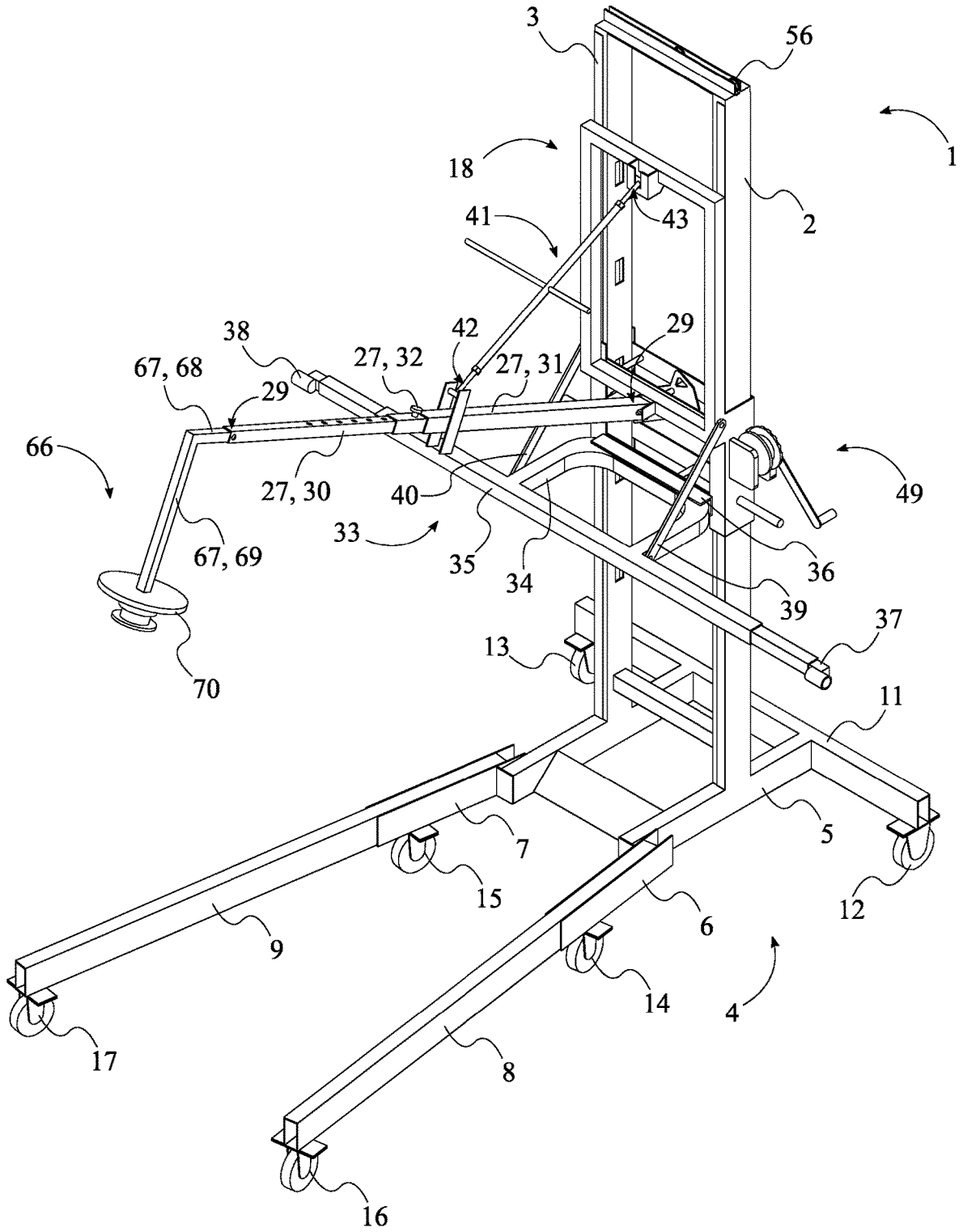
FIG. 13 is a top front perspective view showing the present invention, wherein the present invention is shown with a fifth-wheel attachment attached to the telescopic boom.

To enable the present invention to remove a fifth wheel from a truck, the present invention may further comprise a fifth-wheel attachment 66. As can be seen in FIG. 13, the fifth-wheel attachment 66 comprises an L-shaped bar 67 and a fifth-wheel kingpin 70. The L-shaped bar 67 positions the fifth-wheel kingpin 70 low enough to engage with the fifth wheel. The L-shaped bar 67 comprises a first bar section 68 and a second bar section 69 preferably corresponding to the two straight sections of the L-shaped bar 67. The first bar section 68 is telescopically engaged into the second boom end 29 to secure the L-shaped bar 67 to the telescopic boom 27. The second bar section 69 is terminally and perpendicularly connected to the first bar section 68, offset from the second boom end 29, to form the L-shaped structure. Further, the fifth-wheel kingpin 70 is terminally mounted onto the second bar section 69, opposite the first bar section 68. So, to remove a fifth wheel from a truck, the operator lowers the height-adjustment carriage 18 using the winch mechanism 49 low enough until the fifth-wheel kingpin 70 engages with the fifth wheel. Once engaged, the operator can raise the height-adjustment carriage 18 to lift the fifth wheel using the fifth-wheel attachment 66 until the fifth wheel is clear from obstacles.

Figure 15:
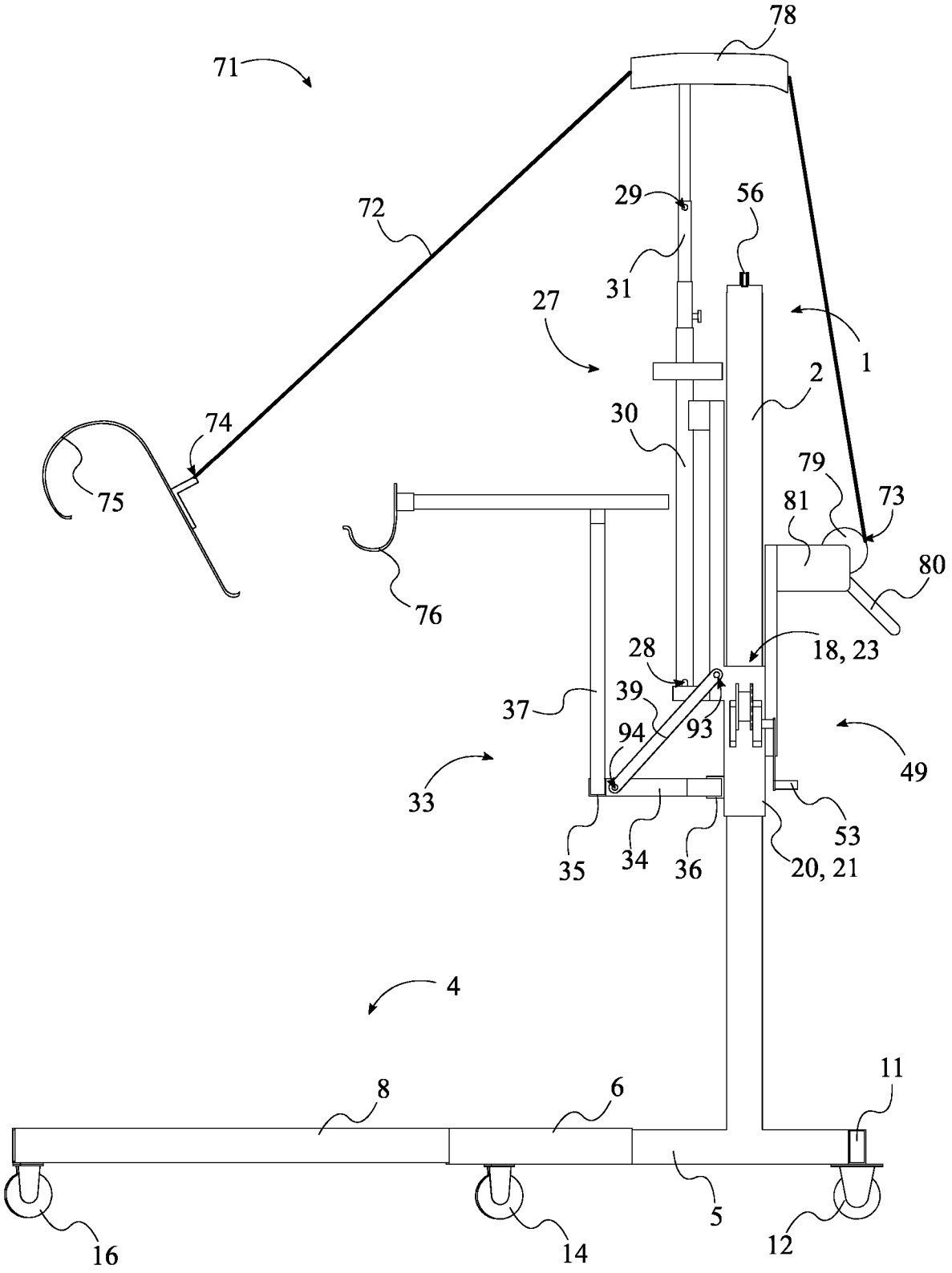
FIG. 15 is a left-side view showing the present invention, wherein the present invention is shown equipped with a scooping kit.
Figure 16:
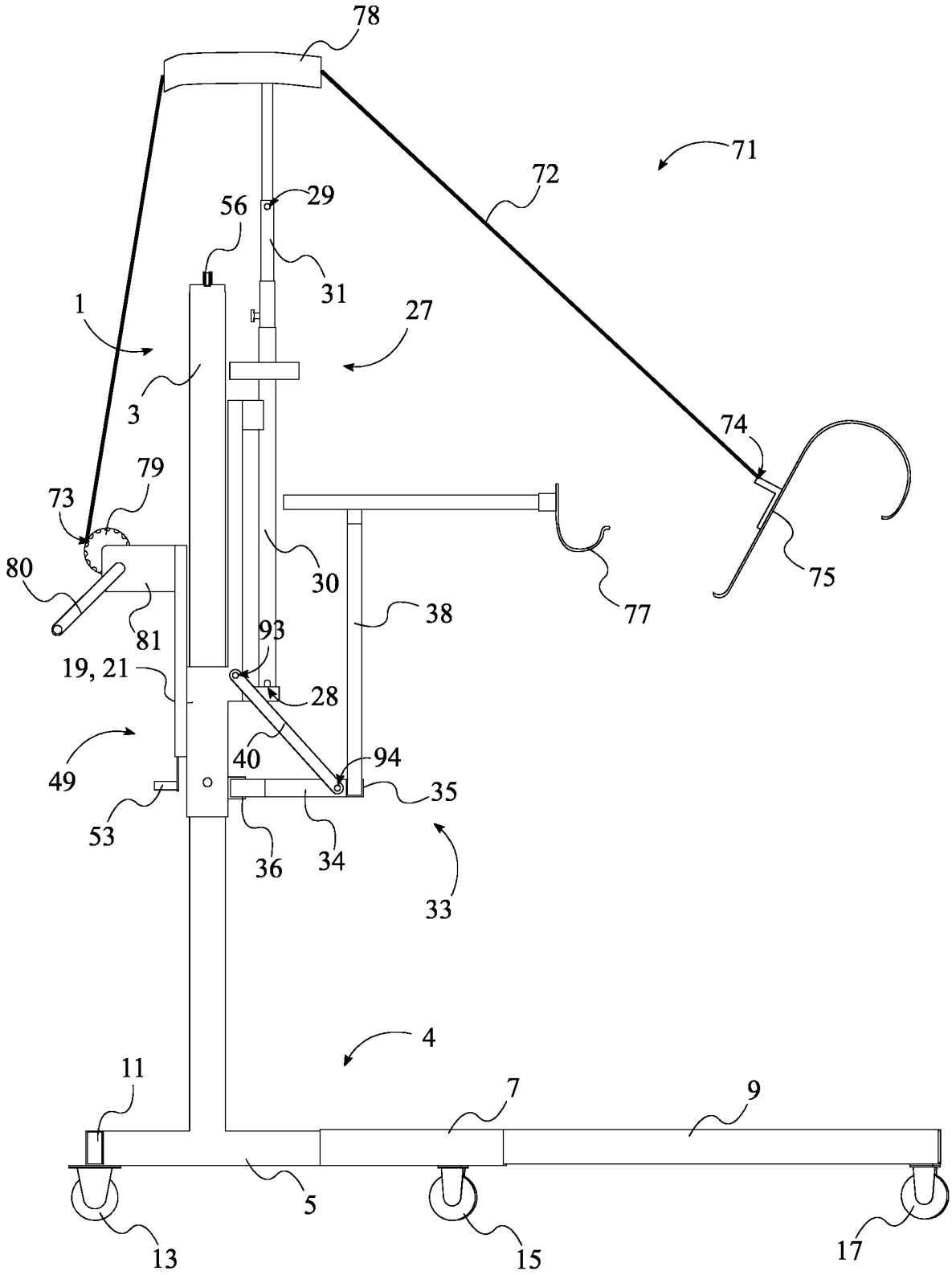
FIG. 16 is a right-side view showing the present invention, wherein the present invention is shown equipped with the scooping kit.

As can be seen in FIGS. 15 and 16, to enable the present invention to remove the hood of a trailer, the present invention may further comprise a scooping kit 71 that can safely and securely engage with the hood of the trailer. To do so, the scooping kit 71 comprises a hoisting strap 72, an upper scoop 75, a first lower scoop 76, a second lower scoop 77, a strap guide 78, a second spool 79, a second crank 80, and a second ratcheting mechanism 81. The hoisting strap 72 comprises a first strap end 73 and a second strap end 74 preferably corresponding to the ends of the hoisting strap 72. The second spool 79 is laterally and rotatably mounted onto the height-adjustment carriage 18, opposite to the telescopic boom 27, to reel in and out the hoisting strap 72. The strap guide 78 is telescopically engaged into the second boom end 29 to guide the movement of the hoisting strap 72. Further, the first strap end 73 is laterally connected to the second spool 79 to secure the hoisting strap 72 to the second spool 79. The hoisting strap 72 is also tethered through the strap guide 78 so that the hoisting strap 72 does not come loose from the strap guide 78. In addition, the upper scoop 75 is connected onto the second strap end 74 so that the upper scoop 75 is tethered to the hoisting strap 72. The upper scoop 75 is also oriented towards the wheeled base 4 so that the upper scoop 75 can engage with the inner edge of the hood of the truck. Similar to the winch mechanism 49, the second crank 80 is torsionally connected to the second spool 79 so that the second spool 79 can be manually rotated using the second crank 80.

In addition, similar to the first ratcheting mechanism 54, the second ratcheting mechanism 81 is operatively integrated into the rotatable connection between the second spool 79 and the height-adjustment carriage 18. As can be seen in FIGS. 15 and 16, the second ratcheting mechanism 81 is used to selectively allow rotation of the second spool 79 in one direction and to selectively prevent rotation of the second spool 79 in an opposite direction. This prevents the second spool 79 from unwinding the hoisting strap 72 due to the load on the upper scoop 75. Furthermore, the first lower scoop 76 is mounted adjacent to the pivot support assembly 33. On the other hand, the second lower scoop 77 is mounted adjacent to the pivot support assembly 33, opposite to the first lower scoop 76. The first lower scoop 76 and the second lower scoop 77 are also oriented away from the wheeled base 4 in order to receive the front lower edge of the hood of the truck. So, to remove the hood from the truck, the telescopic boom 27 is raised until the telescopic boom 27 is parallel to the elongated frame 1. The safety chain 57 can be used to keep the telescopic boom 27 upright. The upper scoop 75 is then engaged with the upper inner edge of the hood of the truck. The first lower scoop 76 and the second lower scoop 77 are also engaged with the front lower edge of the hood of the truck. Once everything is properly engaged, the operator can reel in the hoisting strap 72 using the second crank 80 until the rear of the hood is raised high enough. Then, the winch mechanism 49 is used to raise the height-adjustment carriage 18, which raises the hood from the truck until the hood is clear from obstacles.

Figure 17:
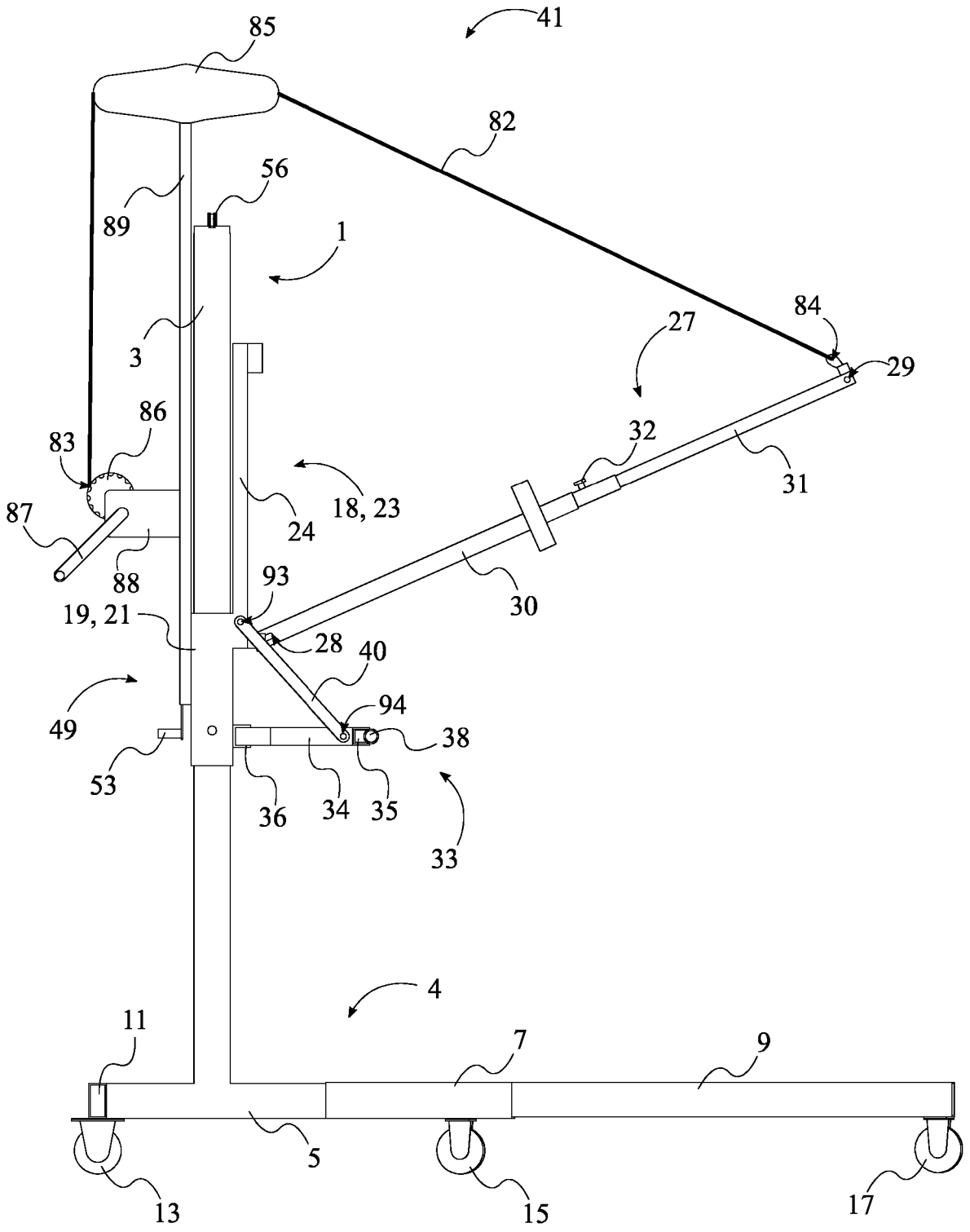
FIG. 17 is a right-side view showing a second embodiment of the tilt-adjustment mechanism of the present invention.

The present invention allows the operator to tilt the vehicle component at steeper angles if necessary. As can be seen in FIG. 17, the tilt-adjustment mechanism 41 can be further designed to tilt a pickup box in an upward position for under box repairs, sandblasting, restoration, painting, or rustproofing. To do so, the tilt-adjustment mechanism 41 may comprise a second hoisting cable 82, a cable guide 85, a third spool 86, a third crank 87, a third ratcheting mechanism 88, and a support rod 89. Similar to the first hoisting cable 50, the second hoisting cable 82 comprises a third cable end 83 and a fourth cable end 84. The support rod 89 is laterally connected to the height-adjustment carriage 18, offset to the winch mechanism 49, to receive the third spool 86. So, the support rod 89 is positioned parallel to the elongated frame 1. The support rod 89 is also oriented away from the wheeled base 4. Then, the third spool 86 is laterally and rotatably mounted onto the support rod 89. The cable guide 85 is terminally mounted to the support rod 89, offset from the height-adjustment carriage 18, to raise the second hoisting cable 82 above the elongated frame 1. Further, the third cable end 83 is laterally connected to the third spool 86 to secure the second hoisting cable 82 to the third spool 86. The second hoisting cable 82 is also tethered through the cable guide 85 to prevent the second hoisting cable 82 from coming loose. The fourth cable end 84 is connected onto the second boom end 29 to secure the second hoisting cable 82 to the telescopic boom 27. Similar to the first crank 53, the second crank 80 is torsionally connected to the third spool 86. Also similar to the first ratcheting mechanism 54, the third ratcheting mechanism 88 is operatively integrated into the rotatable connection between the third spool 86 and the support rod 89. The third ratcheting mechanism 88 is used to selectively allow rotation of the third spool 86 in one direction and to selectively prevent rotation of the third spool 86 in an opposite direction. So, to tilt a vehicle component hanging from the telescopic boom 27, the operator rotates the third spool 86 using the third crank 87 to reel in the second hoisting cable 82 which further raises the portion of the vehicle component suspended on the second boom end 29.

Figure 14:
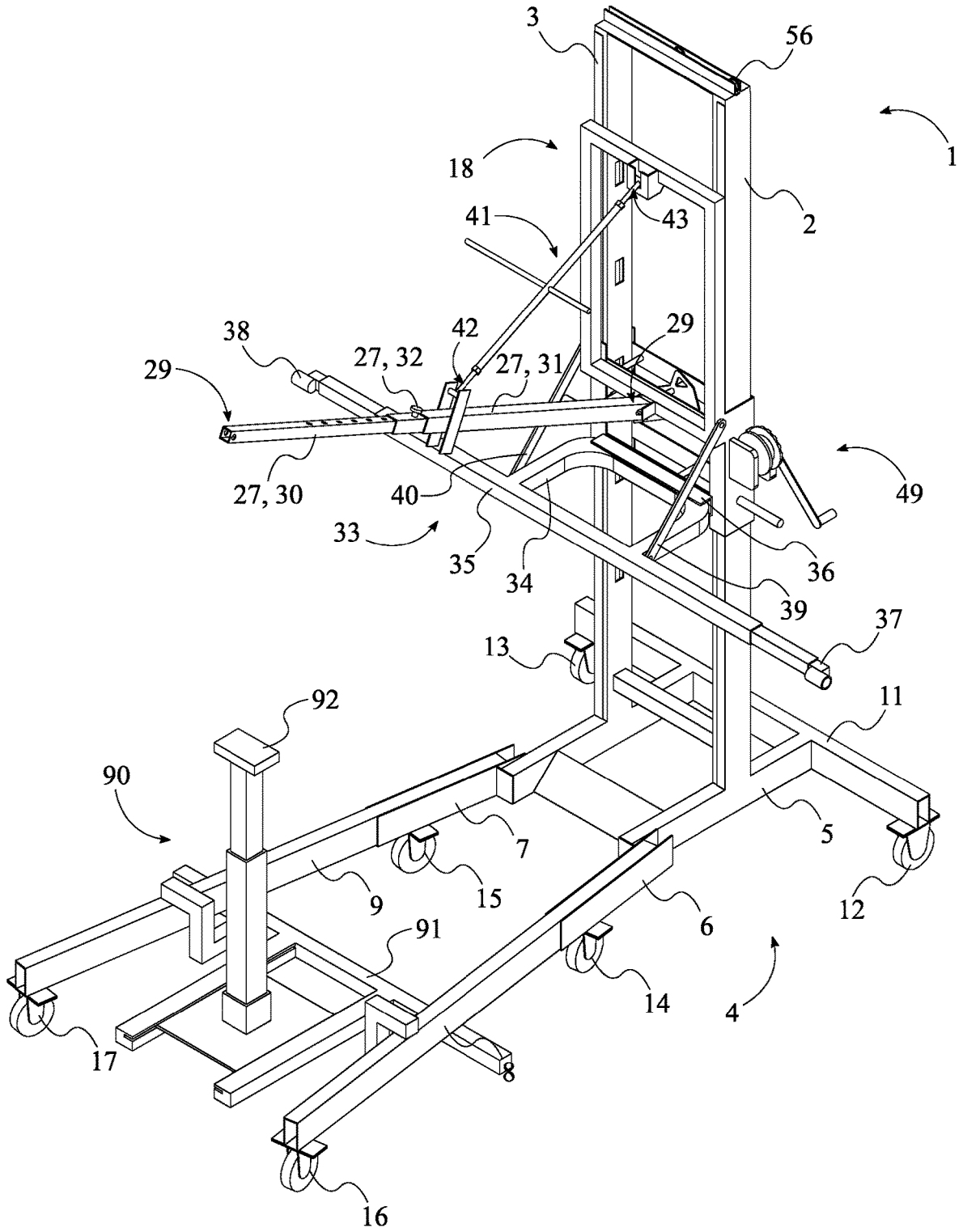
FIG. 14 is a top front perspective view showing the present invention, wherein the present invention is shown with a stabilizer kit mounted onto the wheeled base.

Furthermore, when working on large vehicle components, the present invention may further comprise a stabilizer kit 90 that provides additional support to the vehicle component while being suspended on the telescopic boom 27. The stabilizer kit 90 prevents the vehicle component hanging from the second boom end 29 from moving around or rocking as the operator works on the vehicle component. As can be seen in FIG. 14, the stabilizer kit 90 comprises a cradle 91 and a telescopic stand 92. The cradle 91 serves to keep the telescopic stand 92 in an upright position so that the telescopic stand 92 can support some of the load from the vehicle component. To attach the stabilizer kit 90 to the present invention, the cradle 91 is mounted across the wheeled base 4, offset from the elongated frame 1. The cradle 91 is preferably designed to securely sit on top of the first leg extension 8 and the second leg extension 9. Then, the telescopic stand 92 is connected normal onto the cradle 91. The telescopic stand 92 can be length adjusted to match the height of the vehicle component hanging from the telescopic boom 27. In other embodiments, the present invention can provide additional attachments that accommodate asymmetrical vehicle components.

Although the invention has been explained in relation to its preferred embodiment, it is to be understood that many other possible modifications and variations can be made without departing from the spirit and scope of the invention.

What is claimed is:

1. A heavy load lifting system comprising:

an elongated frame;

a wheeled base;

a height-adjustment carriage;

a telescopic boom;

a pivot support assembly;

a tilt-adjustment mechanism;

a winch mechanism;

the telescopic boom comprising a first boom end and a second boom end;

the tilt-adjustment mechanism comprising a first mechanism end and a second mechanism end;

the wheeled base being terminally mounted to the elongated frame;

the height-adjustment carriage being slidably mounted along the elongated frame;

the first boom end being hingedly connected to the height-adjustment carriage;

the pivot support assembly being mounted onto the height-adjustment carriage, offset from the first boom end;

the first mechanism end being hingedly and laterally connected to the telescopic boom;

the second mechanism end being attached to the height-adjustment carriage; and, the winch mechanism being operatively coupled between the elongated frame and the height-adjustment carriage, wherein the winch mechanism is used to raise and lower the height-adjustment carriage along the elongated frame.

2. The heavy load lifting system as claimed in claim 1 comprising:

the elongated frame comprising a first rail and a second rail;

the height-adjustment carriage comprising a first rail-receiving guide and a second rail-receiving guide;

the first rail and the second rail being positioned parallel to each other;

the first rail-receiving guide and the second rail-receiving guide being positioned opposite to each other across the height-adjustment carriage;

the first rail-receiving guide being movably engaged along the first rail; and, the second rail-receiving guide being movably engaged along the second rail.

3. The heavy load lifting system as claimed in claim 2 comprising:

the first rail-receiving guide and the second rail-receiving guide each comprising a guide body and at least one guide roller;

the guide body being integrated into the height-adjustment carriage;

the at least one guide roller being rotatably mounted to the guide body;

the at least one guide roller of the first rail-receiving guide being rollably engaged to the first rail; and, the at least one guide roller of the second rail-receiving guide being rollably engaged to the second rail.

4. The heavy load lifting system as claimed in claim 1 comprising:

the wheeled base comprising a base body, a first base leg, a second base leg, a first leg extension, and a second leg extension;

the first base leg and the second base leg being connected adjacent the base body;

the first base leg and the second base leg being positioned offset from each other;

the first base leg and the second base leg being oriented away from the elongated frame;

the first base leg and the second base leg being oriented at an acute angle with each other;

the first leg extension being hingedly connected to the first base leg; and, the second leg extension being hingedly connected to the second base leg.

5. The heavy load lifting system as claimed in claim 4 comprising:

the wheeled base further comprising a stabilizing bar, a first lockable caster, and a second lockable caster;

the base body being laterally positioned to the stabilizing bar;

the stabilizing bar being connected adjacent to the base body, opposite to the first base leg and the second base leg;

the first lockable caster being terminally connected to the stabilizing bar; and, the second lockable caster being terminally connected to the stabilizing bar, opposite the first lockable caster.

6. The heavy load lifting system as claimed in claim 4 comprising:

the wheeled base further comprising a first leg caster, a second leg caster, a first extension caster, and a second extension caster;

the first leg caster being terminally connected to the first base leg, offset from the base body;

the second leg caster being terminally connected to the second base leg, offset from the base body;

the first extension caster being terminally connected to the first leg extension, offset from the base body; and, the second extension caster being terminally connected to the second leg extension, offset from the base body.

7. The heavy load lifting system as claimed in claim 1 comprising:

the tilt-adjustment mechanism comprising a turnbuckle body, a first threaded rod, a second threaded rod, and a turnbuckle handle;

the first threaded rod, the turnbuckle body, and the second threaded rod being axially positioned with each other;

the first threaded rod being threadably engaged into the turnbuckle body;

the second threaded rod being threadably engaged into the turnbuckle body, opposite to the second threaded rod; and, the turnbuckle handle being connected perpendicular to the turnbuckle body.

8. The heavy load lifting system as claimed in claim 7 comprising:

a detachable ball-and-socket joint;

the height-adjustment carriage comprising a carriage body and a support arch;

the support arch being connected adjacent the carriage body;

the support arch being oriented away from the wheeled base;

the detachable ball-and-socket joint being positioned adjacent to the support arch, offset from the carriage body; and, the second mechanism end being pivotably attached to the support arch by the detachable ball-and-socket joint.

9. The heavy load lifting system as claimed in claim 1 comprising:

a safety chain;

the height-adjustment carriage further comprising a first handle and a second handle;

the first handle and the second handle being positioned opposite to each other across the height-adjustment carriage;

the first handle being laterally connected to the height-adjustment carriage;

the second handle being laterally connected to the height-adjustment carriage, opposite to the first handle; and, the safety chain being tethered in between the first handle and the second handle.

10. The heavy load lifting system as claimed in claim 1 comprising:

the pivot support assembly comprising a U-shaped bar, a length-adjustable bar, and a bar-engagement brace;

the bar-engagement brace being laterally connected to the height-adjustment carriage;

the bar-engagement brace being positioned in between the telescopic boom and the wheeled base;

the U-shaped bar being attached into the bar-engagement brace;

the U-shaped bar being laterally positioned to the length-adjustable bar;

the length-adjustable bar being positioned perpendicular to the elongated frame; and, the length-adjustable bar being connected adjacent to the U-shaped bar, opposite the bar-engagement brace.

11. The heavy load lifting system as claimed in claim 10 comprising:

the pivot support assembly further comprising a first mounting bracket and a second mounting bracket;

the first mounting bracket being terminally mounted to the length-adjustable bar; and, the second mounting bracket being terminally mounted to the length-adjustable bar, opposite to the first mounting bracket.

12. The heavy load lifting system as claimed in claim 10 comprising:

the pivot support assembly further comprising a first suspension beam and a second suspension beam;

the first suspension beam and the second suspension beam each comprising a proximal beam end and a distal beam end;

the first suspension beam and the second suspension beam being positioned parallel and offset from each other;

the proximal beam end being hingedly connected to the height-adjustment carriage; and, the distal beam end being hingedly connected to the U-shaped bar.

13. The heavy load lifting system as claimed in claim 1 comprising:

the winch mechanism comprising a first hoisting cable, a first crank, a first ratcheting mechanism, a first spool, and a pulley system;

the first hoisting cable comprising a first cable end and a second cable end;

the first spool being laterally and rotatably connected to the height-adjustment carriage;

the pulley system being terminally mounted to the elongated frame, opposite to the wheeled base;

the first cable end being laterally connected to the first spool;

the first hoisting cable being tethered through the pulley system;

the second cable end being connected to the height-adjustment carriage;

the first crank being torsionally connected to the first spool; and, the first ratcheting mechanism being operatively integrated into the rotatable connection between the first spool and the height-adjustment carriage, wherein the first ratcheting mechanism is used to selectively allow rotation of the first spool in one direction and to selectively prevent rotation of the first spool in an opposite direction.

14. The heavy load lifting system as claimed in claim 13 comprising:

a spring-loaded safety latch;

a plurality of latch slots;

the spring-loaded safety latch being hingedly connected within the height-adjustment carriage;

the second cable end being tethered to the height-adjustment carriage by the spring-loaded safety latch;

the plurality of latch slots being distributed along the elongated frame; and, the plurality of latch slots being integrated within the elongated frame.

15. The heavy load lifting system as claimed in claim 1 comprising:

the telescopic boom further comprising a first boom pole, a second boom pole, and a locking mechanism;

the first boom pole being positioned coincident to the first boom end;

the second boom pole being positioned coincident to the second boom end;

the first boom pole and the second boom pole being telescopically engaged with each other; and, the locking mechanism being operatively integrated between the first boom pole and the second boom pole, wherein the locking mechanism is used to lock the second boom pole in place along the first boom pole.

16. The heavy load lifting system as claimed in claim 1 comprising:

a clamping bar;

the clamping bar comprising a bar body, a first extension arm, a second extension arm, a first frictional bracket, and a second frictional bracket;

the bar body being positioned perpendicular to the telescopic boom;

the second boom end being laterally positioned to the bar body;

the bar body being hingedly connected to the second boom end;

the first extension arm being telescopically engaged with the bar body;

the second extension arm being telescopically engaged with the bar body, opposite to the first extension arm;

the first frictional bracket being terminally connected to the first extension arm, offset the bar body; and, the second frictional bracket being terminally connected to the second extension arm, offset the bar body.

17. The heavy load lifting system as claimed in claim 1 comprising:

a fifth-wheel attachment;

the fifth wheel attachment comprising an L-shaped bar and a fifth-wheel kingpin;

the L-shaped bar comprising a first bar section and a second bar section;

the first bar section being telescopically engaged into the second boom end;

the second bar section being terminally and perpendicularly connected to the first bar section, offset from the second boom end; and, the fifth-wheel kingpin being terminally mounted onto the second bar section, opposite the first bar section.

18. The heavy load lifting system as claimed in claim 1 comprising:

a scooping kit;

the scooping kit comprising a hoisting strap, an upper scoop, a first lower scoop, a second lower scoop, a strap guide, a second spool, a second crank, and a second ratcheting mechanism;

the hoisting strap comprising a first strap end and a second strap end;

the second spool being laterally and rotatably mounted onto the height-adjustment carriage, opposite to the telescopic boom;

the strap guide being telescopically engaged into the second boom end;

the first strap end being laterally connected to the second spool;

the hoisting strap being tethered through the strap guide;

the upper scoop being connected onto the second strap end;

the upper scoop being oriented towards the wheeled base;

the second crank being torsionally connected to the second spool;

the second ratcheting mechanism being operatively integrated into the rotatable connection between the second spool and the height-adjustment carriage, wherein the second ratcheting mechanism is used to selectively allow rotation of the second spool in one direction and to selectively prevent rotation of the second spool in an opposite direction;

the first lower scoop being mounted adjacent to the pivot support assembly;

the second lower scoop being mounted adjacent to the pivot support assembly, opposite to the first lower scoop; and, the first lower scoop and the second lower scoop being oriented away from the wheeled base.

19. The heavy load lifting system as claimed in claim 1 comprising:

the tilt-adjustment mechanism comprising a second hoisting cable, a cable guide, a third spool, a third crank, a third ratcheting mechanism, and a support rod;

the second hoisting cable comprising a third cable end and a fourth cable end;

the support rod being laterally connected to the height-adjustment carriage, offset to the winch mechanism;

the support rod being positioned parallel to the elongated frame;

the support rod being oriented away from the wheeled base;

the third spool being laterally and rotatably mounted onto the support rod;

the cable guide being terminally mounted to the support rod, offset from the height-adjustment carriage;

the third cable end being laterally connected to the third spool;

the second hoisting cable being tethered through the cable guide;

the fourth cable end being connected onto the second boom end;

the second crank being torsionally connected to the third spool; and, the third ratcheting mechanism being operatively integrated into the rotatable connection between the third spool and the support rod, wherein the third ratcheting mechanism is used to selectively allow rotation of the third spool in one direction and to selectively prevent rotation of the third spool in an opposite direction.

20. The heavy load lifting system as claimed in claim 1 comprising:

a stabilizer kit;

the stabilizer kit comprising a cradle and a telescopic stand;

the cradle being mounted across the wheeled base, offset from the elongated frame; and, the telescopic stand being connected normal onto the cradle.

* * * * *